US010736469B2

(12) United States Patent
Allen

(10) Patent No.: US 10,736,469 B2
(45) Date of Patent: Aug. 11, 2020

(54) TUB OR SHOWER SURROUND KIT SYSTEM AND METHOD

(71) Applicant: Francis Allen, South Fork, CO (US)

(72) Inventor: Francis Allen, South Fork, CO (US)

( * ) Notice: Subject to any disclaimer, the term of this patent is extended or adjusted under 35 U.S.C. 154(b) by 131 days.

(21) Appl. No.: 15/960,855

(22) Filed: Apr. 24, 2018

(65) Prior Publication Data

US 2018/0303291 A1 Oct. 25, 2018

Related U.S. Application Data

(60) Provisional application No. 62/489,604, filed on Apr. 25, 2017.

(51) Int. Cl.

| | |
|---|---|
| ***A47K 3/04*** | (2006.01) |
| ***E04F 13/073*** | (2006.01) |
| ***A47K 3/28*** | (2006.01) |
| ***E04F 13/08*** | (2006.01) |

(52) U.S. Cl.

CPC ..... *A47K 3/281* (2013.01); *A47K 3/04* (2013.01); *A47K 3/283* (2013.01); *E04F 13/0733* (2013.01); *E04F 13/0864* (2013.01)

(58) Field of Classification Search

CPC ..... A47K 3/281; A47K 3/283; A47K 3/04; E04F 13/0733; E04F 13/0864

USPC ..... 52/35, 582.1; 4/584, 580, 600

See application file for complete search history.

(56) References Cited

U.S. PATENT DOCUMENTS

| | | | | | |
|---|---|---|---|---|---|
| 1,664,463 | A * | 4/1928 | Muryn | E04F 13/12 | 52/278 |
| 2,423,722 | A * | 7/1947 | Nilson | A47K 3/283 | 52/264 |
| 2,648,409 | A * | 8/1953 | Daugherty | A47K 3/284 | 52/264 |
| 2,677,268 | A * | 5/1954 | Hobbs | A47K 3/008 | 52/35 |
| 3,158,237 | A | 11/1964 | Schooler | | |
| 3,281,172 | A * | 10/1966 | Kuehl | A47K 3/284 | 52/592.1 |
| 3,304,676 | A * | 2/1967 | Sallie | E04F 13/0864 | 52/276 |
| 3,314,203 | A * | 4/1967 | Hill | E04B 1/34342 | 52/288.1 |
| 3,525,188 | A * | 8/1970 | Torbett | E04F 19/064 | 52/288.1 |
| 3,827,086 | A | 8/1974 | Seymour et al. | | |

(Continued)

*Primary Examiner* — Brent W Herring

(74) *Attorney, Agent, or Firm* — Trenner Law Firm, LLC; Mark D. Trenner

(57) ABSTRACT

A tub or shower surround kit, system, and method are disclosed. An example system for constructing a tub surround, shower surround, and wall covering includes a plurality of components including at least one panel, at least one edge component, and at least one interconnecting component. The example system also includes a tongue or lip of a first of the plurality of components configured to fit into a groove of a second of the plurality of components. The example system also includes a tongue or lip of the second of the plurality of components to fit into a groove of the first of the plurality of components. Any number of the plurality of components are connected adjacent a desired wall geometry to provide an assembled version of the tub surround, shower surround, and wall covering.

15 Claims, 27 Drawing Sheets

(56) References Cited

U.S. PATENT DOCUMENTS 3,977,136 A * 8/1976 Daniels ..... A47K 3/04 52/35
3,996,703 A * 12/1976 Daniels ..... A47K 3/04 52/35
4,109,426 A * 8/1978 Dobija ..... A47K 3/001 4/584
4,299,064 A * 11/1981 Daniels ..... A47K 3/001 4/580
4,384,377 A 5/1983 Calvert et al.
4,569,092 A 2/1986 Baus
4,817,344 A 4/1989 Wissinger
4,993,201 A 2/1991 Bunyard
5,079,880 A 1/1992 Reid
5,303,519 A * 4/1994 Mustee ..... A47K 3/283 52/34
5,347,784 A * 9/1994 Crick ..... E04D 1/265 52/314
5,435,021 A 7/1995 Williams
5,619,826 A * 4/1997 Wu ..... E04H 1/1216 52/35
5,671,489 A 9/1997 Salach
5,694,728 A * 12/1997 Heath, Jr. ..... E04D 3/32 52/518
5,829,071 A * 11/1998 Lavalle ..... A47K 3/001 4/580
5,870,878 A * 2/1999 Swingle ..... A47K 3/04 312/140.4
6,155,021 A * 12/2000 Swingle ..... A47K 3/04 108/27
D445,491 S 7/2001 Paredes
D495,789 S 9/2004 Helmetsie et al.
D561,308 S 2/2008 Breymaier et al.
8,037,556 B2 10/2011 Lock et al.
8,332,972 B2 * 12/2012 Bullis ..... A47K 3/30 4/584
8,402,707 B2 * 3/2013 Mitchell ..... E04C 2/38 52/287.1
8,484,771 B2 7/2013 Wilson et al.
8,596,021 B2 * 12/2013 Van Ravenhorst ... E04F 13/165 4/596
D709,599 S 7/2014 Lobley et al.
8,850,632 B2 * 10/2014 Bullis ..... A47K 3/30 4/584
9,027,176 B2 * 5/2015 Dabrowski ..... A47K 3/04 4/584
9,032,676 B2 * 5/2015 Yarmo ..... E04F 13/0733 52/287.1
9,051,736 B2 * 6/2015 Geels ..... E04C 2/46
9,084,516 B2 * 7/2015 Wilkinson ..... A47K 3/284
9,506,253 B2 11/2016 Rosko et al.
9,642,500 B2 5/2017 Groner et al.
9,833,111 B2 12/2017 Torres
D847,311 S 4/2019 Allen
2004/0074175 A1 * 4/2004 Tierney ..... E04F 13/0864 52/255
2008/0250558 A1 10/2008 Torres
2010/0058531 A1 * 3/2010 Bullis ..... A47K 3/30 4/584
2011/0185670 A1 * 8/2011 Mitchell ..... E04F 13/076 52/539

* cited by examiner

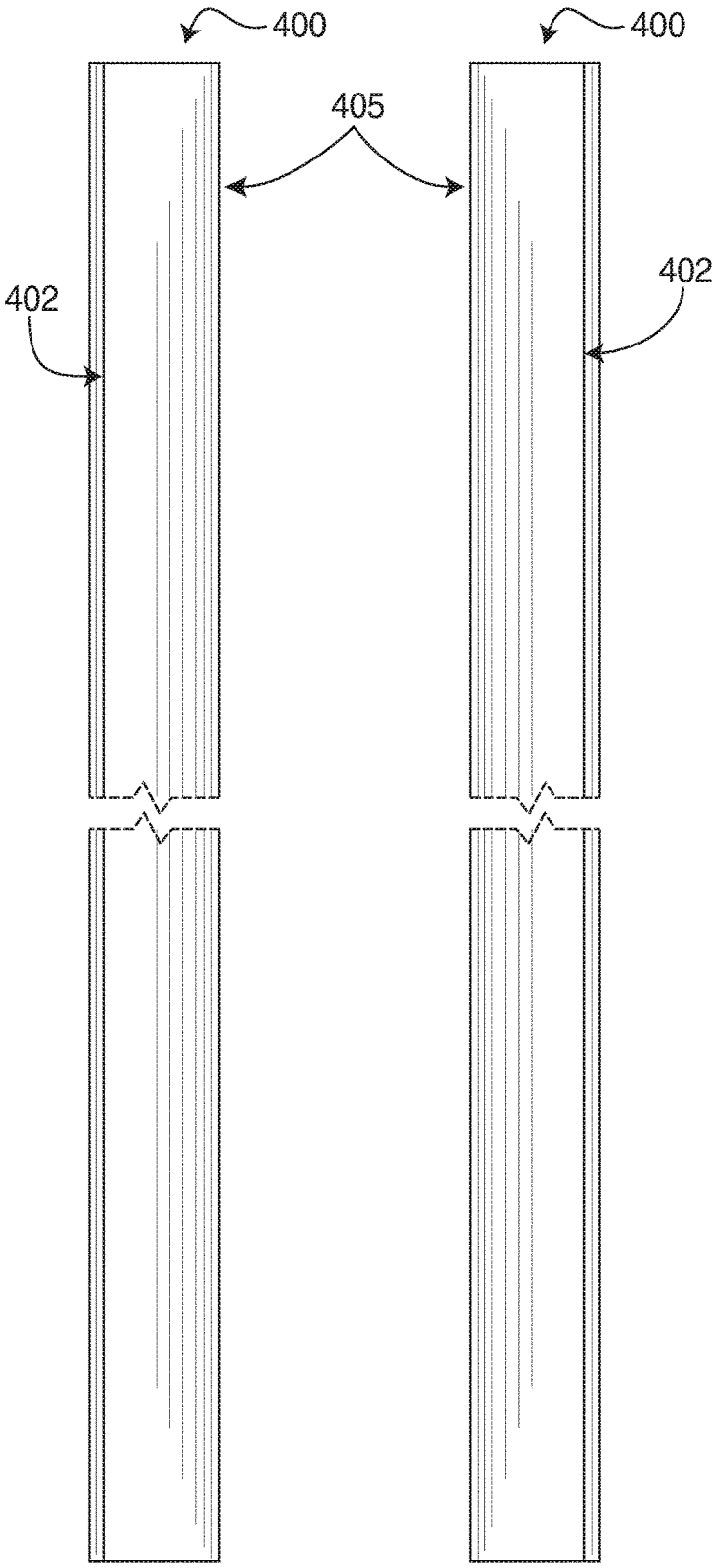
FIG. 20
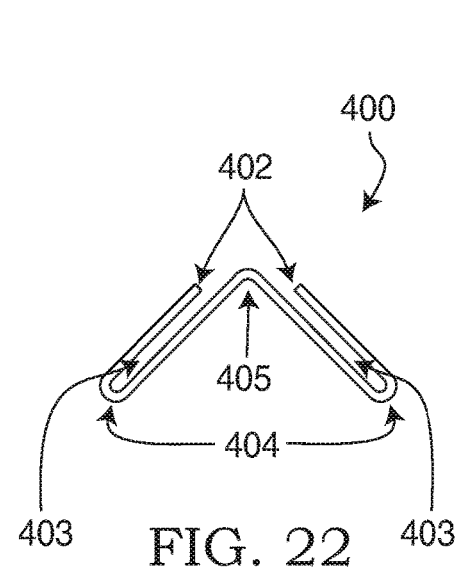
FIG. 21
FIG. 22
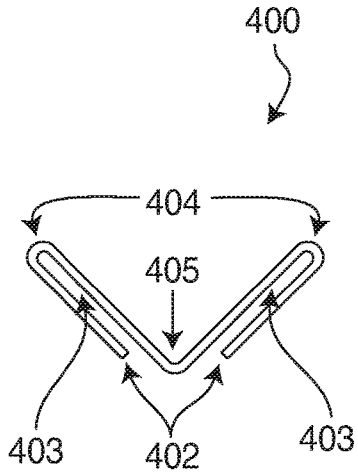
FIG. 23

TUB OR SHOWER SURROUND KIT SYSTEM AND METHOD

CROSS REFERENCE TO RELATED APPLICATIONS

This application claims the priority benefit of U.S. Provisional Patent Application No. 62/489,604 filed Apr. 25, 2017 for "Tub or Surround Kit System and Method," hereby incorporated by reference in its entirety as though fully set forth herein.

BACKGROUND

Shower and tub surrounds have been around since the advent of shower bases and tubs. The surrounds are provided as a decorative finish, and to prevent water from striking or splashing the adjacent walls, potentially damaging the walls. Shower and tub surrounds may be made of tile glued to the walls, or may be made as solid slabs (e.g., granite slabs), or as plastic or fiberglass coverings. These options may be expensive, and do not provide for any variation in the surround.

BRIEF DESCRIPTION OF THE DRAWINGS

FIG. 20 is a right side view of the example corner component.

FIG. 21 is a left side view of the example corner component.

FIG. 22 is a front view of the example corner component.

FIG. 23 is a back view of the example corner component.

DETAILED DESCRIPTION

A surround is disclosed as it may be provided as a "kit" (e.g., components for assembly) for a tub or shower or other wall covering. An example kit may include custom designed trim pieces and large panels, made out of many different kinds of materials.

Examples materials include, but are not limited to metals such as copper, sheet metal, galvanized sheet metal, stainless steel sheet, brass sheet, aluminum sheet. The metal is cut and bent in many different shapes and sizes to accommodate many different sizes and configurations of bathtub/shower and/or shower enclosures.

In another example, the components and panels may be made of plastics, ceramics, laminates, or composites such as concrete or particle boards, and may be formed, sintered, or molded into the appropriate shapes, or may be made of materials such as stone and wood that are milled or etched into the appropriate shapes.

In an example, components may be provided as a kit and assembled by the consumer or a professional, to enclose a bathtub or shower and/or shower area as the surround. The components may also be provided for other wall coverings, or to form surfaces for indoor and/or outdoor water features.

Before continuing, it is noted that as used herein, the terms "includes" and "including" mean, but is not limited to, "includes" or "including" and "includes at least" or "including at least." The term "based on" means "based on" and "based at least in part on."

It is also noted that components shown with "broken" lines indicate that these components may be any length and width.

Figure 1:
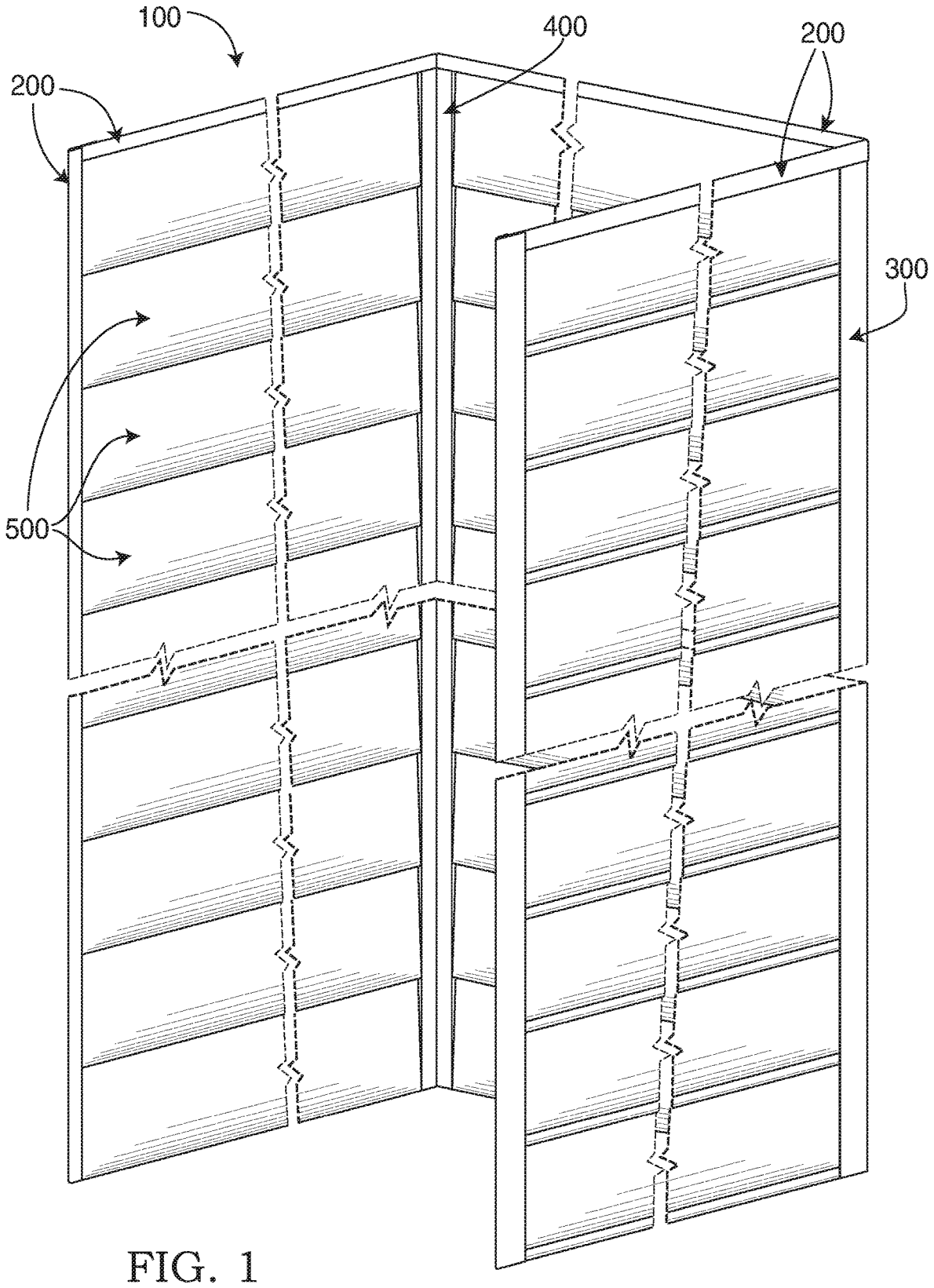
FIG. 1 is a perspective view of an example shower or tub surround kit.
Figure 2:
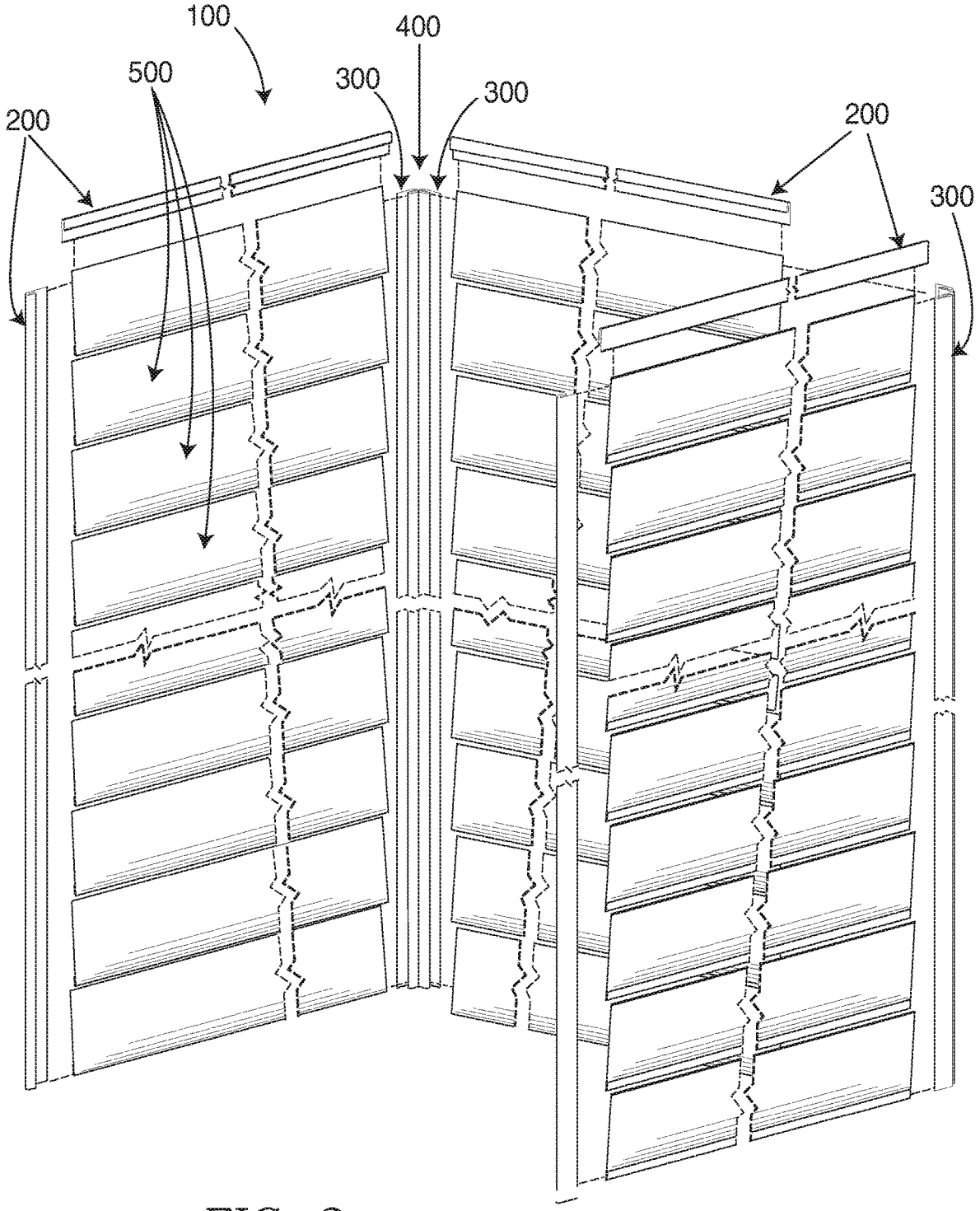
FIG. 2 is an exploded perspective view corresponding to FIG. 1, with the components separated for completeness of illustration.

FIG. 1 is a perspective view of an example assembled shower or tub surround kit 100. The kit 100 may include edge components or edge trim pieces 200, corner-side components 300, corner components 400, and panels 500. FIG. 2 is an exploded perspective view of an example shower or tub surround kit 100 corresponding to FIG. 1, with the components shown separated for completeness of illustration. The edging components or edge trim pieces 200, corner brackets or corner-side components 300, corner components 400, and panels 600, and and their relationships to one another, are more clearly visible in this picture.

In an example, panels 500 are attached to the edging components 200 and corner-side components 300 by a friction-based lip-and-groove architecture that may not require adhesives, fasteners, sealants, welds, or solder, although these may be employed as a design choice.

In an example, trim pieces (e.g., edge components 200, corner-side components 300, and corner components 400) provide a finished appearance after installation.

In an example, the components enable a simple and fast installation that properly provides a water-resistant or waterproof wall covering.

In an example, the components can be removed and reinstalled easily and quickly to perform any necessary maintenance behind the panels without damage to the components.

In an example, the components also enables custom features, such as rounded or curved walls (e.g., by bending and/or shaping the panels).

In an example, the surround can be installed over existing shower enclosures, minimizing or eliminating demolition. The installed surround may also be anticorrosive and antimicrobial (e.g., when made of copper). In addition, the surround kit 100 may require substantially less cleaning than other types of surround (e.g., by incorporating stainless steel components, or metals such as copper that form a natural patina with exposure to air, moisture, and contaminants).

Figure 3:
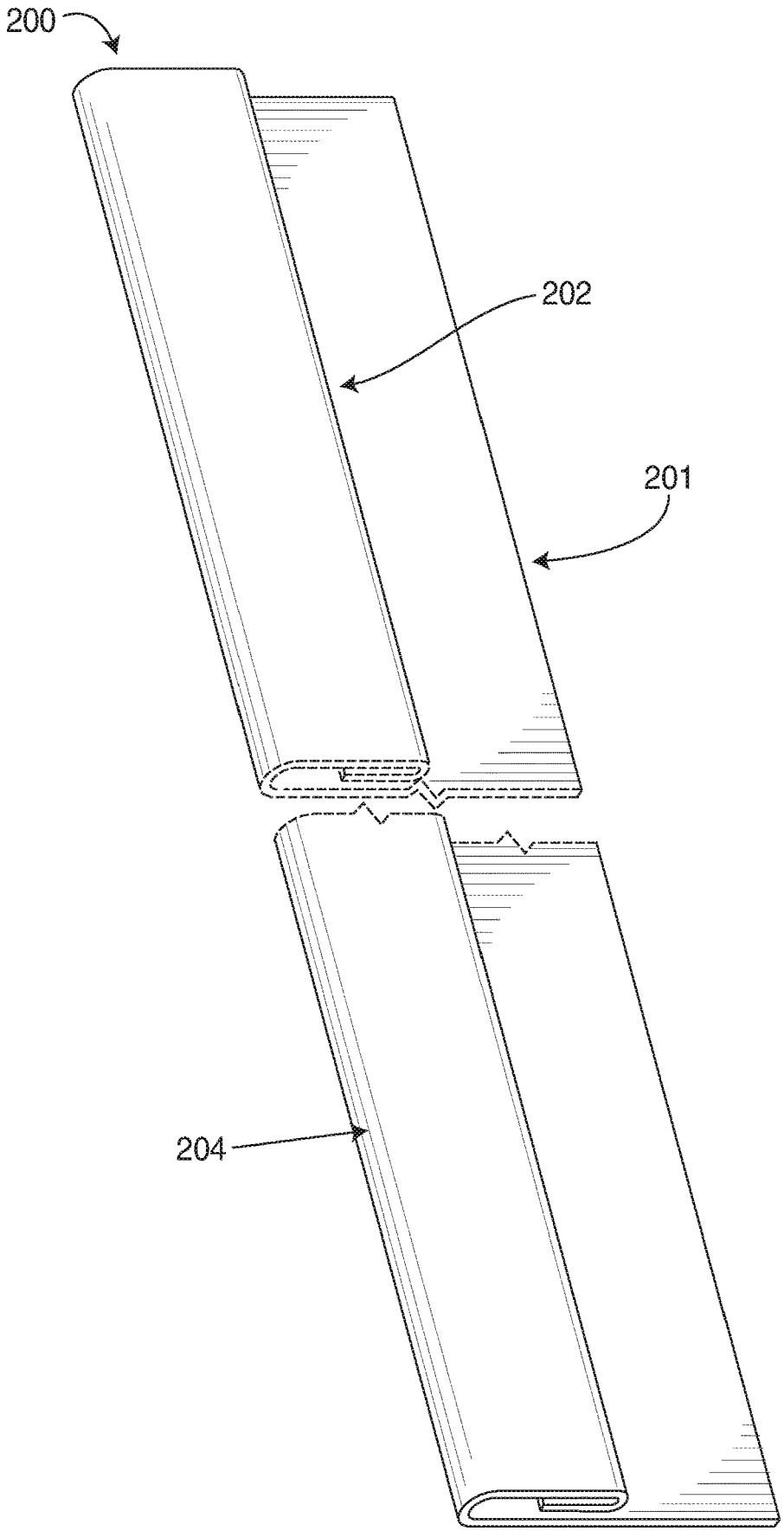
FIG. 3 is a perspective view of an edging component of the example shower or tub surround shown removed from the kit corresponding to FIG. 1 for clarity of disclosure.

FIG. 3 is a perspective view of an edging component 200 of the shower or tub surround which, for clarity of disclosure, is shown removed from the kit corresponding to FIG. 1. In an example, the edging component 200 has a rolled or folded shape that yields a tongue 201, a lip 202, a groove 203, and a back curve 204.

Figure 4:
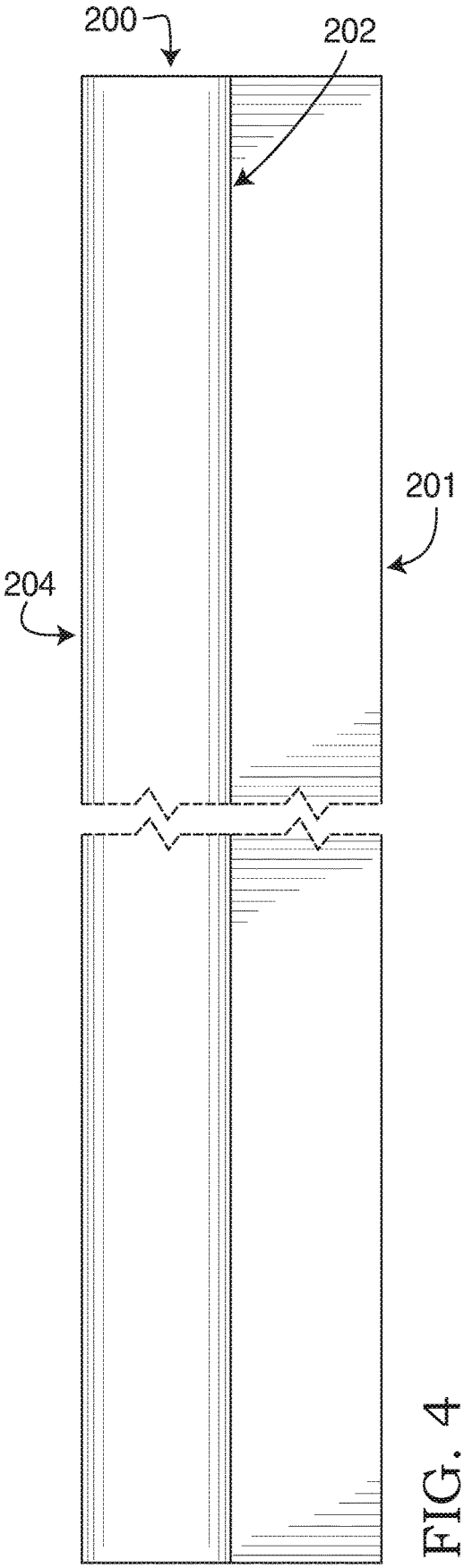
FIG. 4 is a top view of an example edging component.
Figure 5:
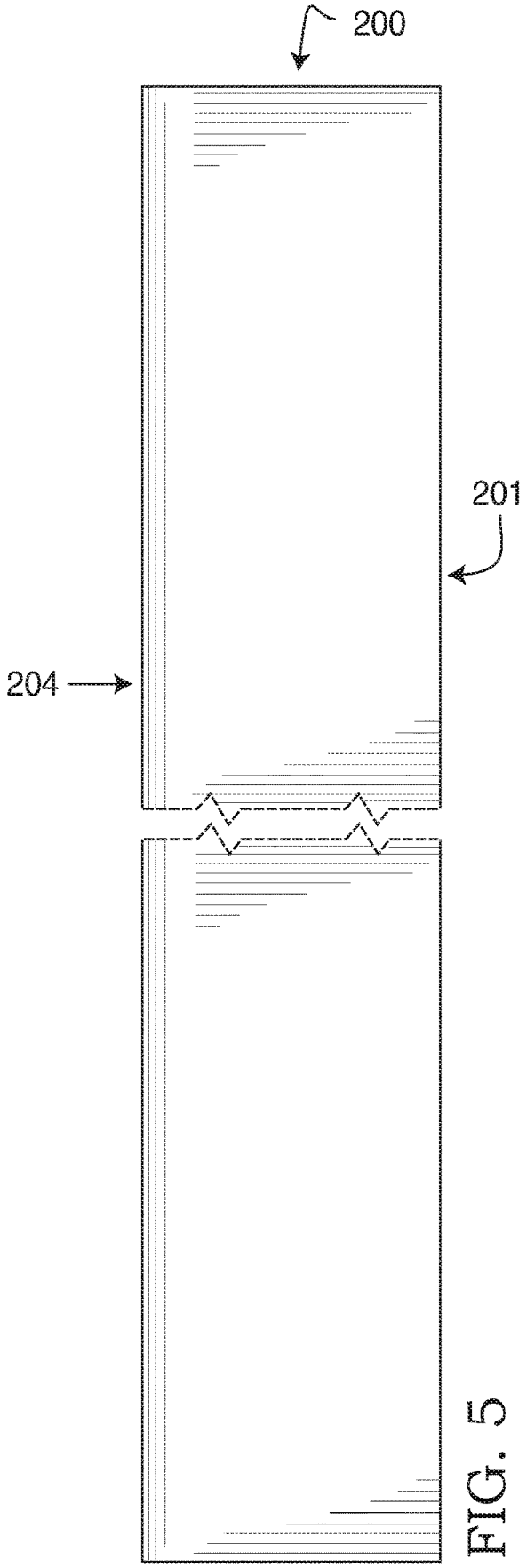
FIG. 5 is a bottom view of the example edging component.
Figure 6:
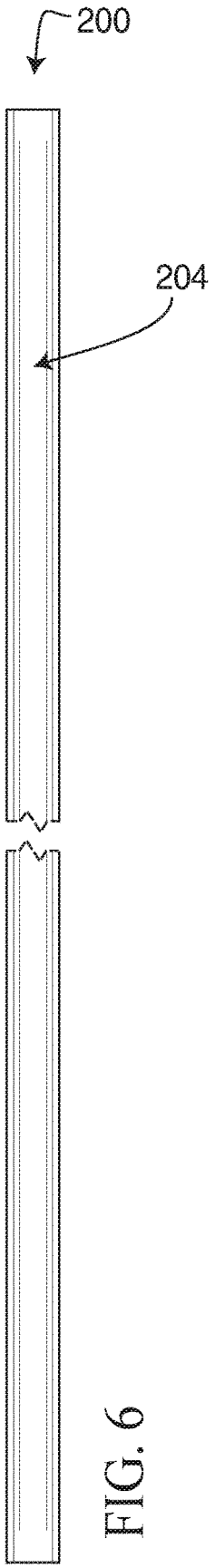
FIG. 6 is a right side view of the example edging component.
Figure 7:
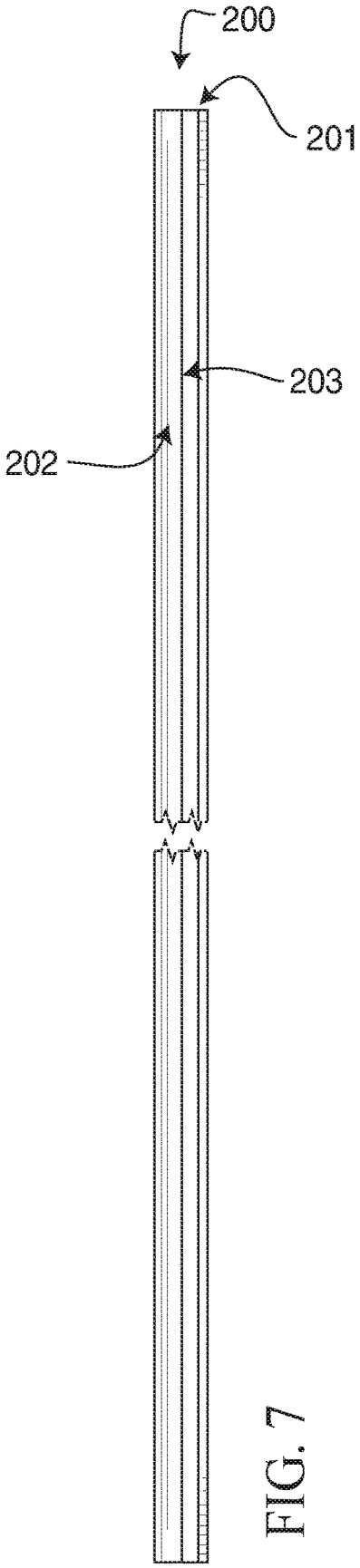
FIG. 7 is a left side view of the example edging component.
Figure 9:
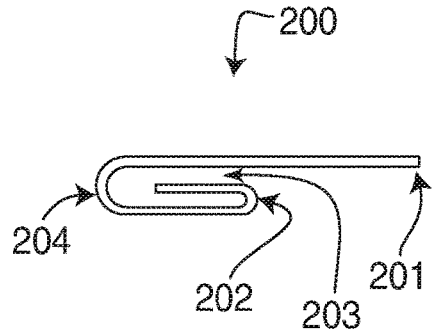
FIG. 9 is a back view of the example edging component.
Figure 8:
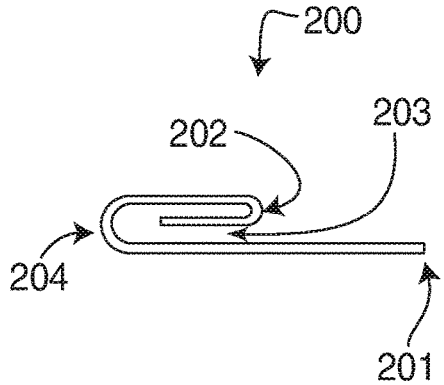
FIG. 8 is a front view of the example edging component.

FIG. 4 is a top view of the edging component 200, in which the tongue 201, lip 202, and back curve 204 are visible, but the groove 203 is hidden. FIG. 5 is a bottom view of the edging component 200, in which the tongue 201 and back curve 204 are visible, but the lip 201 and groove 203 are hidden. FIG. 6 is a right side view of the edging component 200, in which only the back curve 204 is visible. FIG. 7 is a left side view of the edging component 200, in which the tongue 201, lip 202, and groove 203 are visible. FIG. 8 is a front view of the edging component 200, in which the tongue 201, lip 202, groove 203, and back curve 204 are visible. FIG. 9 is a back view of the edging component 200, in which the tongue 201, lip 202, groove 203, and back curve 204 are visible.

In an example, the edging may be provided around an outer side and/or top edge of the surround. The panels can be inserted into the edging to provide a clean look and finish, and eliminate sharp edges.

Figure 10:
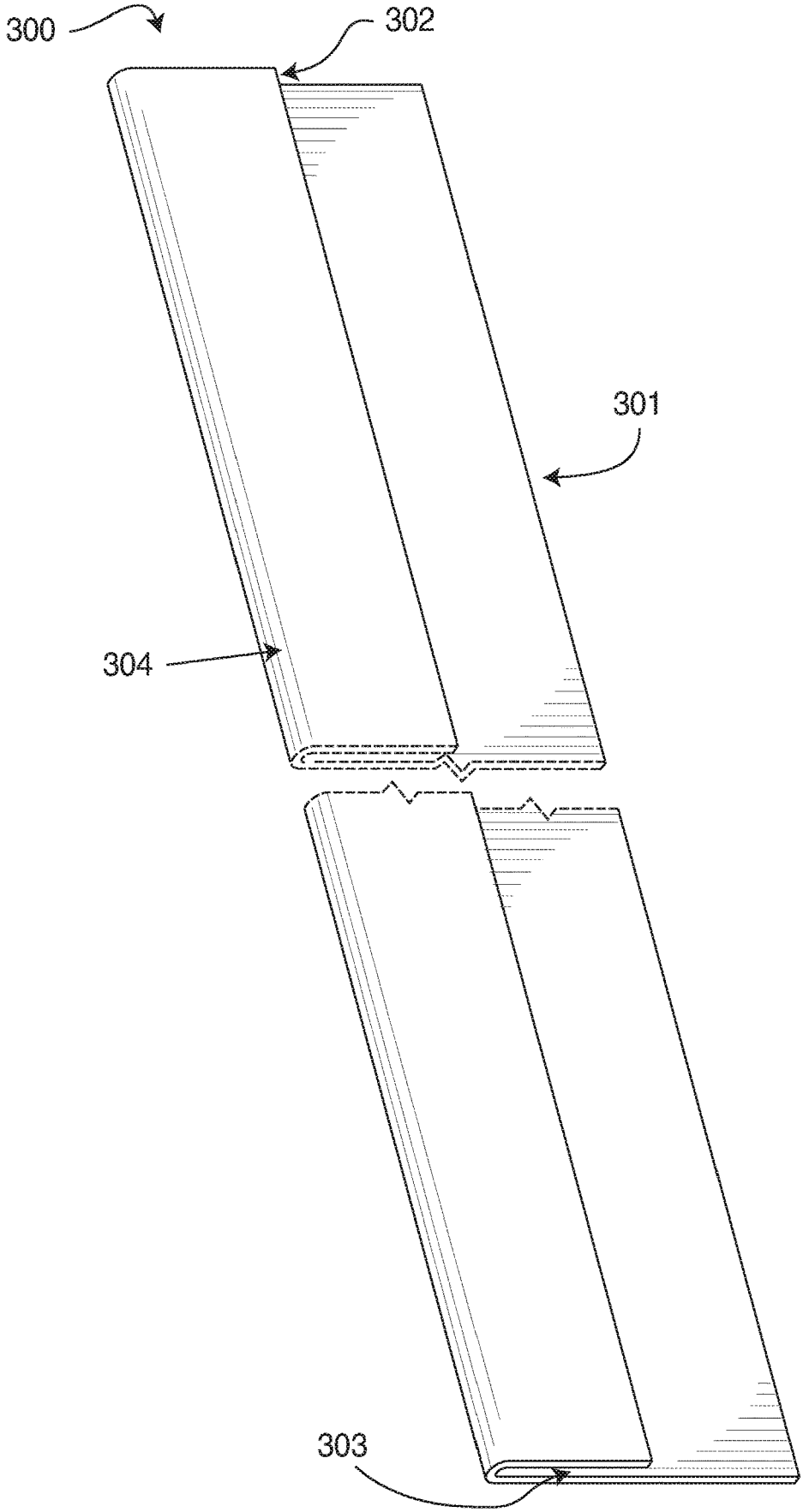
FIG. 10 is a perspective view of an example corner-side component of the example shower or tub surround, shown removed from the kit corresponding to FIG. 1 for clarity of disclosure.

FIG. 10 is a perspective view of an example corner edge component or corner-side component 300 of the shower or tub surround which, for clarity of disclosure, is shown removed from the kit corresponding to FIG. 1. Similar to the edge component 200, the corner-side component 300 has a tongue 301, lip 302, groove 303, and back curve 304.

Figure 11:
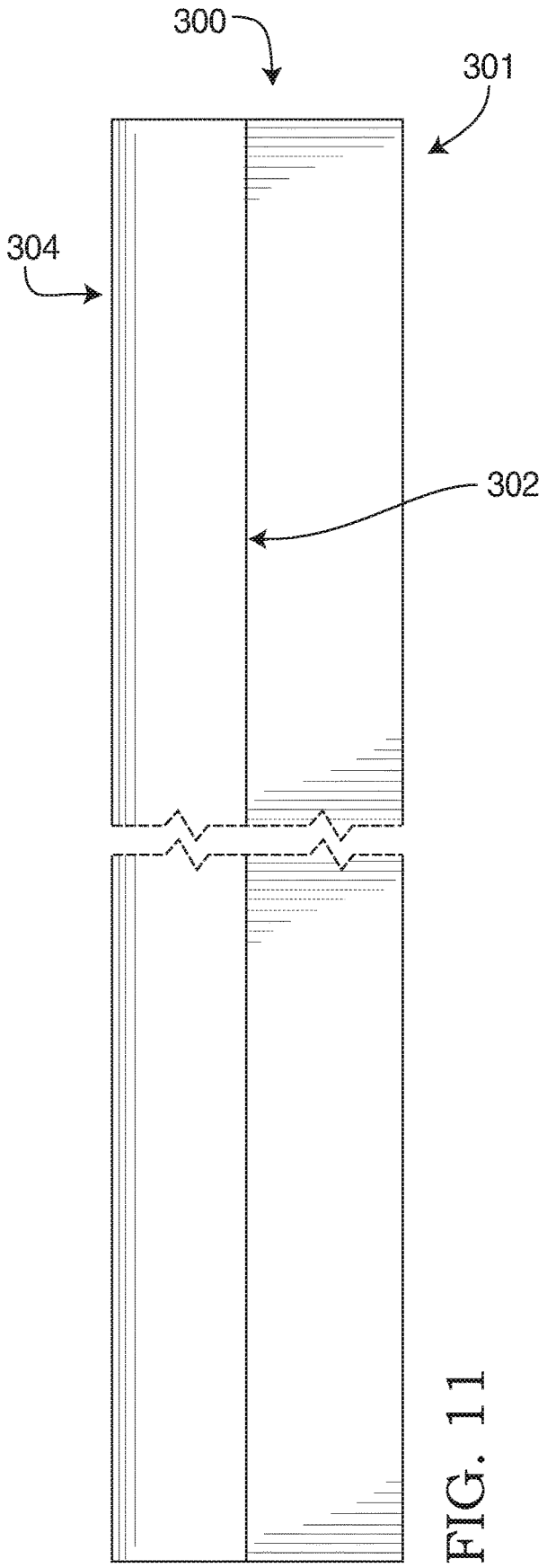
FIG. 11 is a top view of an example corner-side component.
Figure 12:
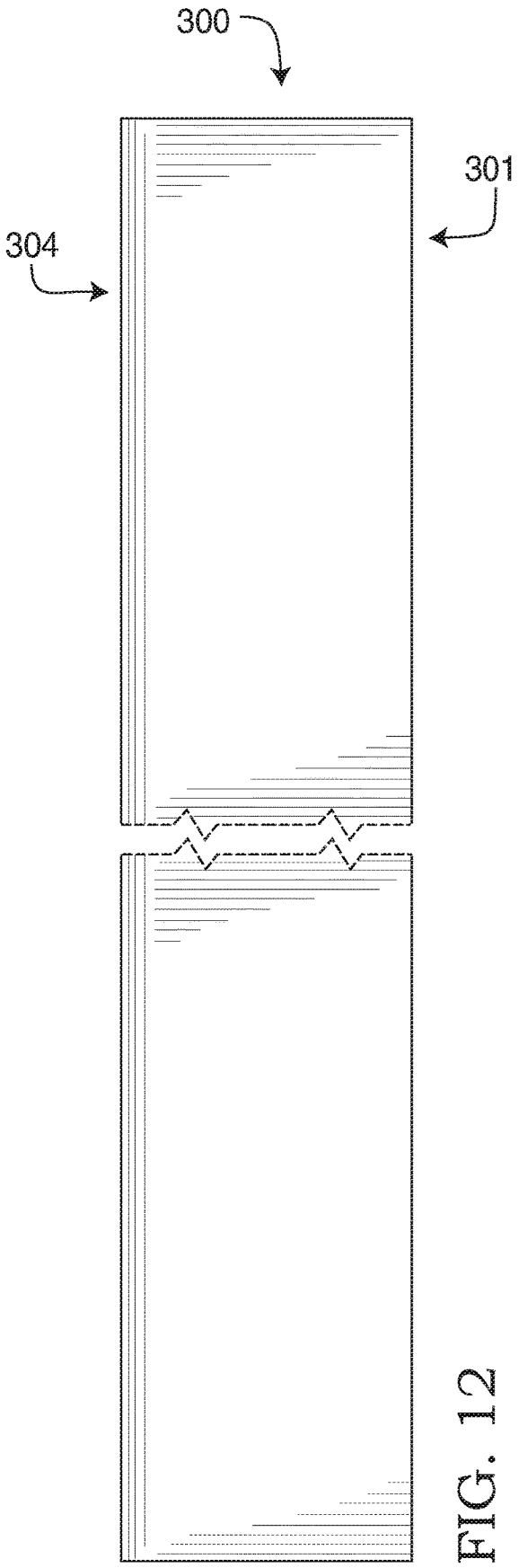
FIG. 12 is a bottom view of the example corner-side component.
Figure 13:
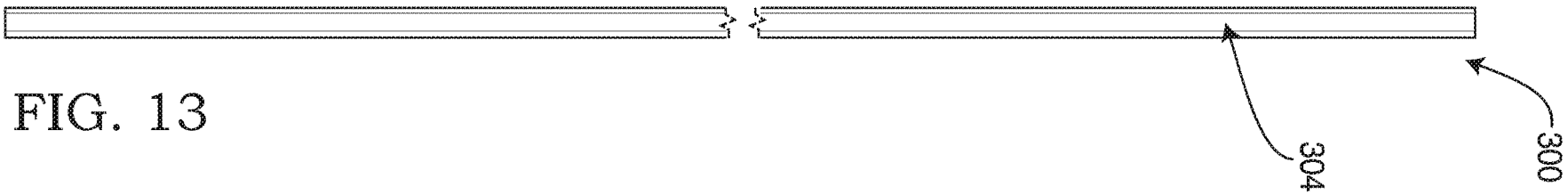
FIG. 13 is a right side view of the example corner-side component.
Figure 14:
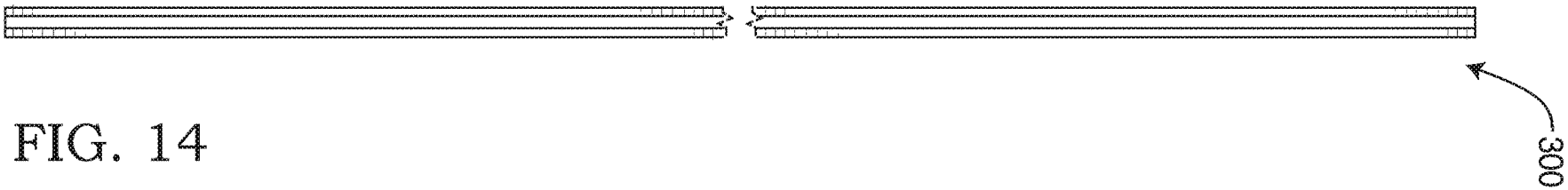
FIG. 14 is a left side view of the example corner-side component.
Figure 15:
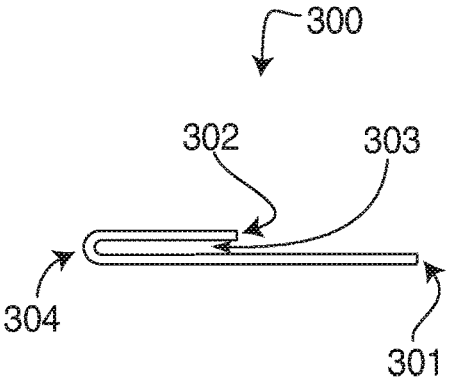
FIG. 15 is a front view of the example corner-side component.
Figure 16:
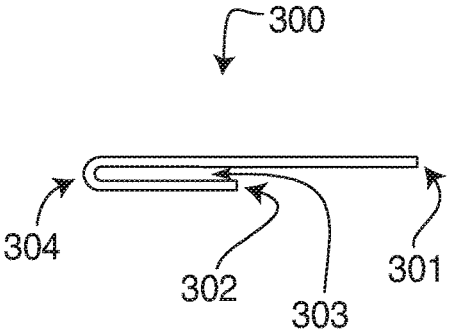
FIG. 16 is a back view of the example corner-side component.
Figure 31:
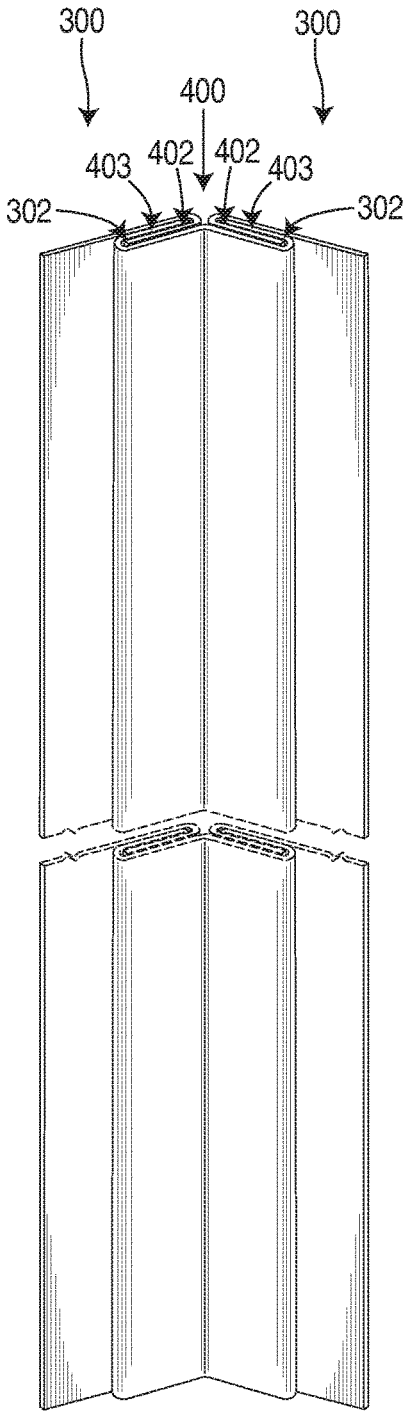
FIG. 31 is a perspective view of an example corner-side component shown in FIG. 10 as it may be assembled to the example corner component shown in FIG. 17, shown removed from the kit corresponding to FIG. 1 for clarity of disclosure.
Figure 32:
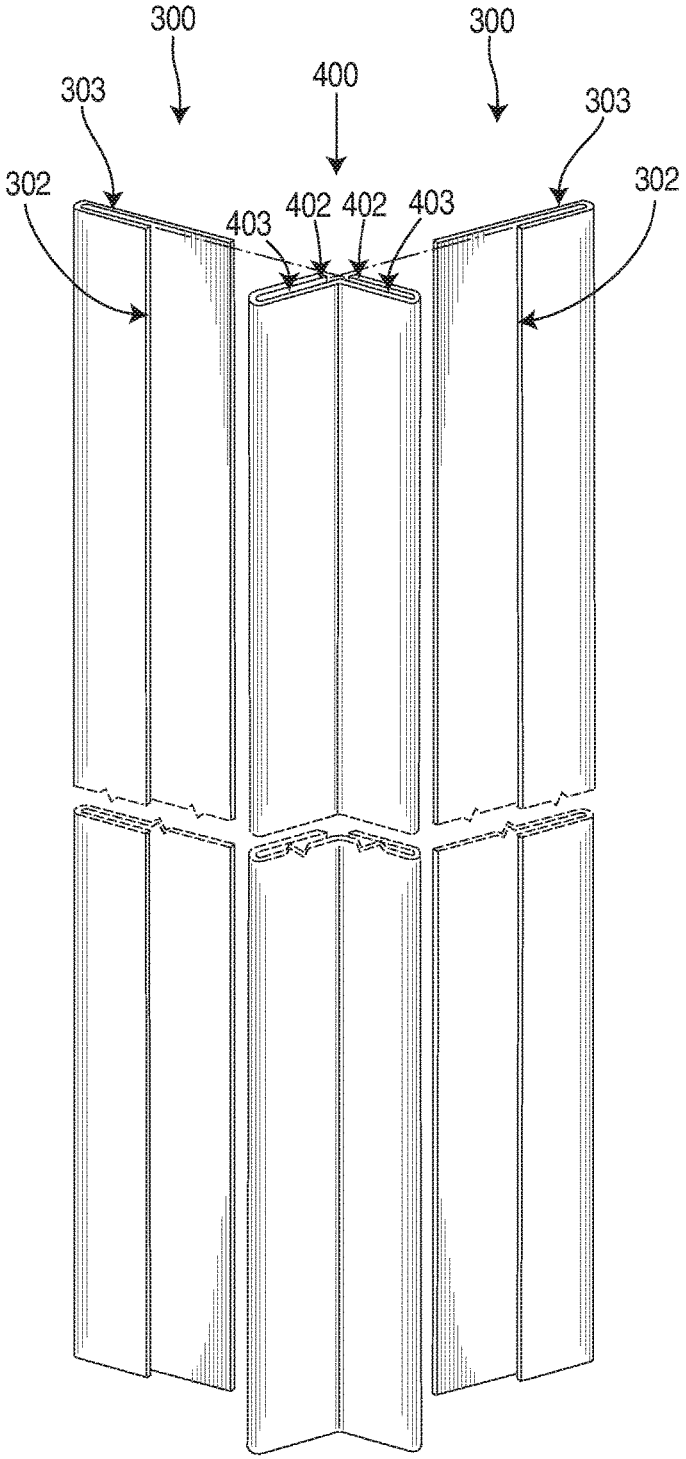
FIG. 32 is an exploded perspective view of the example corner-side component assembled to the example corner component as shown in FIG. 31, with the components separated for completeness of illustration.

FIG. 11 is a top view of the corner-side component 300 in which the tongue 301, lip 302, and back curve 304 are visible. FIG. 12 is a bottom view of the corner-side component 300 in which the tongue 301 and back curve 304 are visible. FIG. 13 is a right side view of the corner-side component 300 in which only the back curve 304 is visible. FIG. 14 is a left side view of the corner-side component 300 in which the tongue 301, lip 302, and groove 303 are visible. FIG. 15 is a front view of the corner-side component 300 in which the tongue 301, lip 302, groove 303, and back curve 204 are visible. FIG. 16 is a back view of the corner-side component 300 in which the tongue 301, lip 302, groove 303, and back curve 204 are visible. The corner-side component 300 may be combined with a corner component (e.g., as shown in FIG. 17) to complete an inside corner as shown in FIGS. 31 and 32.

Figure 17:
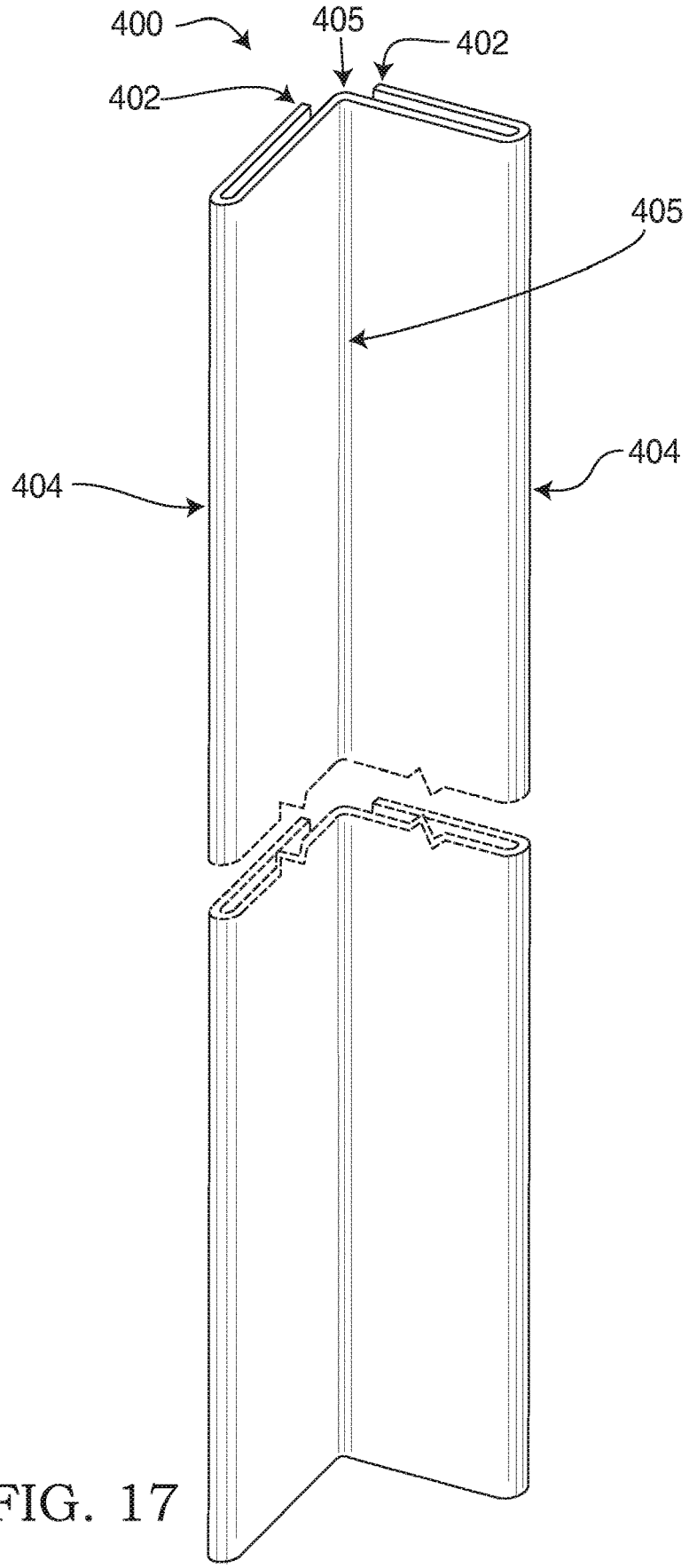
FIG. 17 is a perspective view of another example corner component of the shower or tub surround shown removed from the kit corresponding to FIG. 1 for clarity of disclosure.

FIG. 17 is a perspective view of another example of a corner component 400 of the shower or tub surround which, for clarity of disclosure, is shown removed from the kit corresponding to FIG. 1. The corner component has two lips 402, two grooves 403, two back curves 404, and a corner 405.

Figure 18:
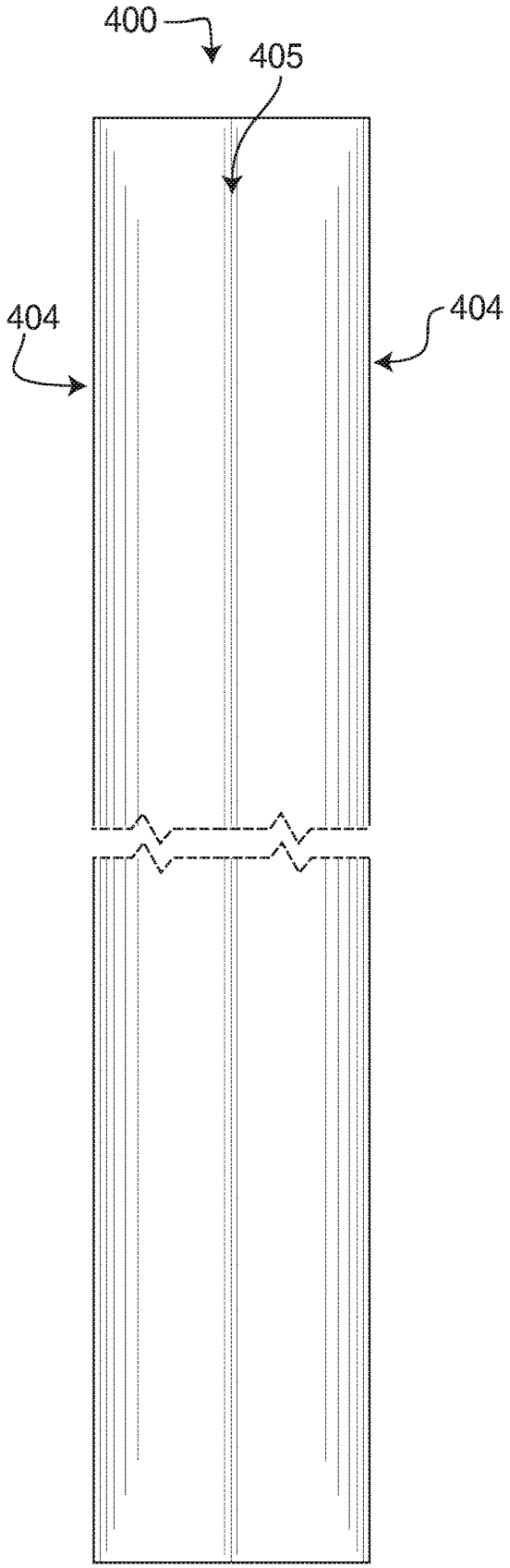
FIG. 18 is a top view of the example corner component.
Figure 19:
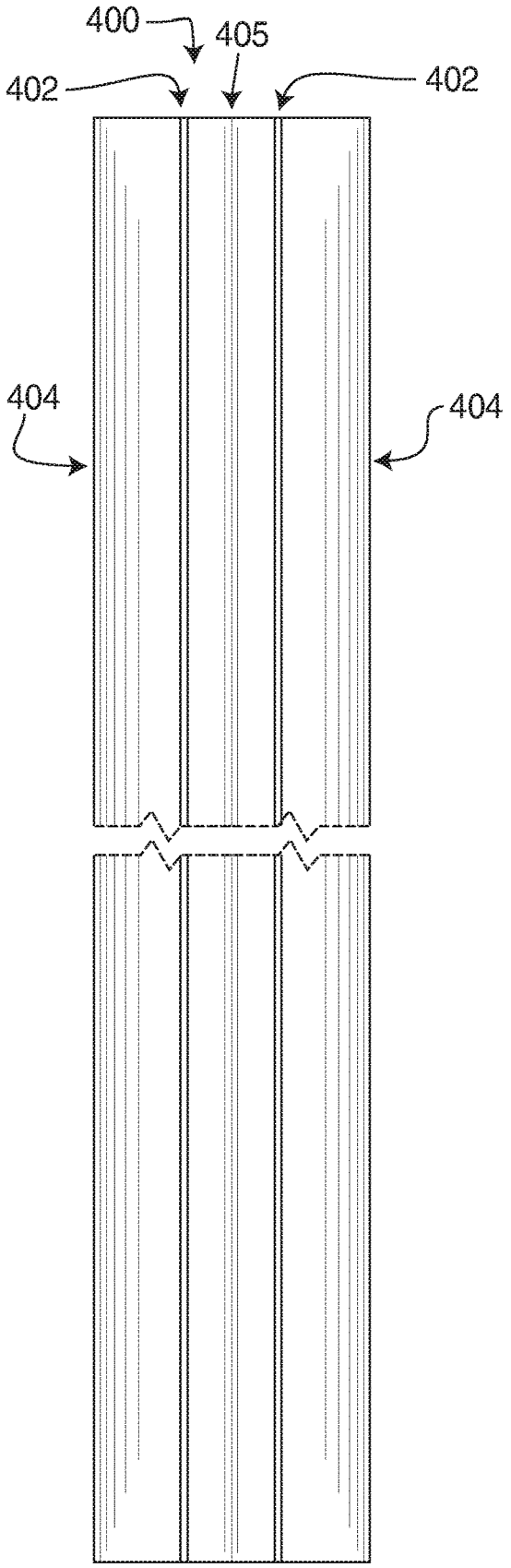
FIG. 19 is a bottom view of the example corner component.

FIG. 18 is a top view of the corner component, in which both back curved 404 and the corner 405 are visible. FIG. 19 is a bottom view of the corner component, in which both tongues 401, both lips 402, both grooves 403, and the corner 405 are visible. FIG. 20 is a right side view of the corner component, in which one tongue 401, one lip 402, one groove 403, and the corner 405 are visible. FIG. 21 is a left side view of the corner component, in which one tongue 401, one lip 402, one groove 403, and the corner 405 are visible. FIG. 22 is a front view of the corner component, in which both tongues 401, both lips 402, both grooves 403, both back curved 404, and the corner 405 are visible. FIG. 23 is a back view of the corner component, in which both tongues 401, both lips 402, both grooves 403, both back curved 404, and the corner 405 are visible.

Figure 24:
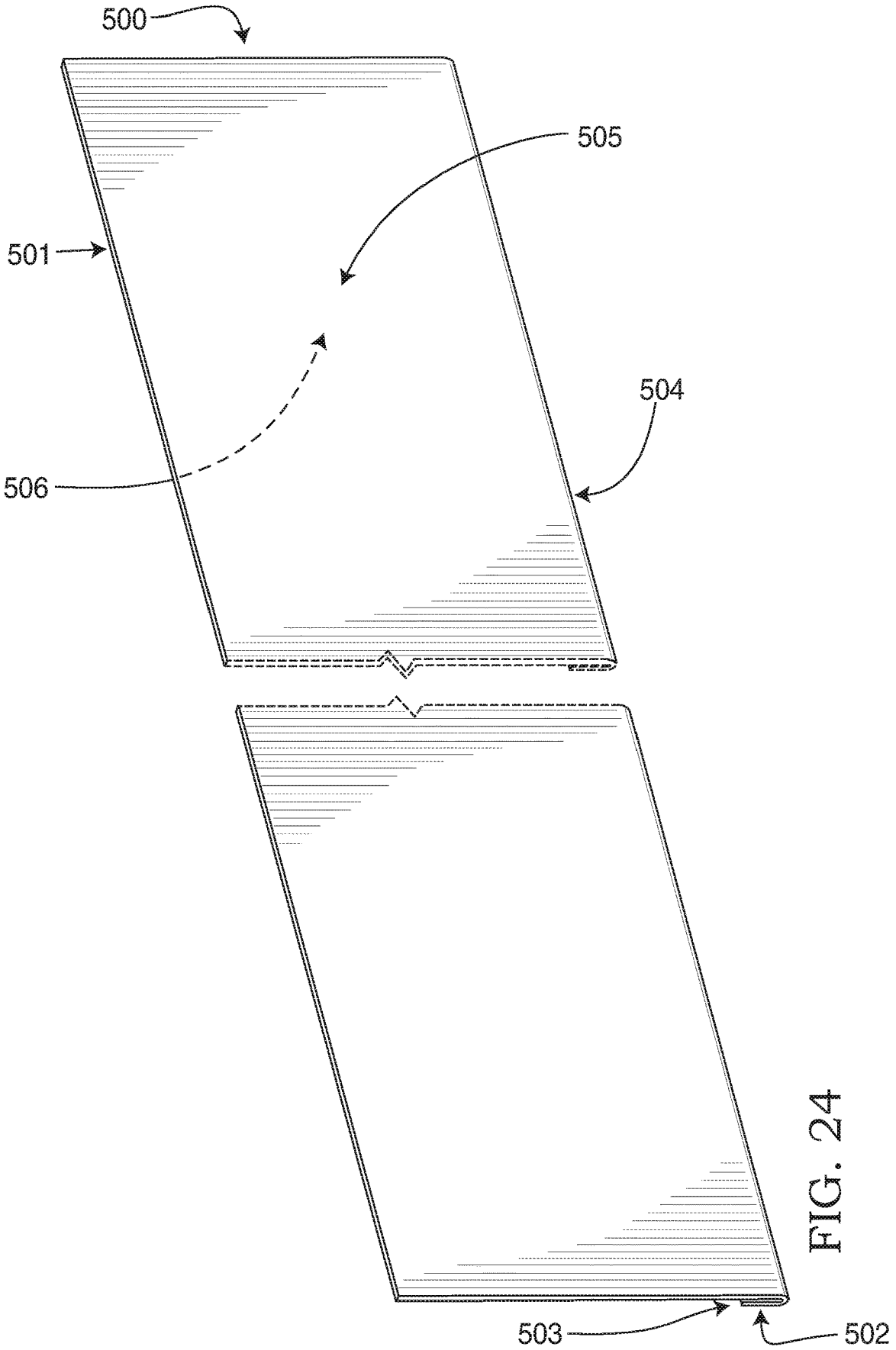
FIG. 24 is a perspective view of an example wall panel component of the example shower or tub surround shown removed from the kit corresponding to FIG. 1 for clarity of disclosure.

FIG. 24 is a perspective view of an example wall panel component or "panel" 500 of the shower or tub surround which, for clarity of disclosure, is shown removed from the kit corresponding to FIG. 1. The panel 500 has a tongue 501, lip 502, groove 503, back curve 504, front face 505, and back face 506. In an example assembled state, the front face 505 of the panel 500 faces inward to the shower or tub, or away from the wall on which the panel 500 hangs. The front face 505 may be decorated or plain. Although the back face 506 may be decorated or plain, in an example assembled state the back face 506 generally faces away from the shower or tub and/or toward the wall on which the panel 500 hangs, and thus may not be directly visible.

Figure 25:
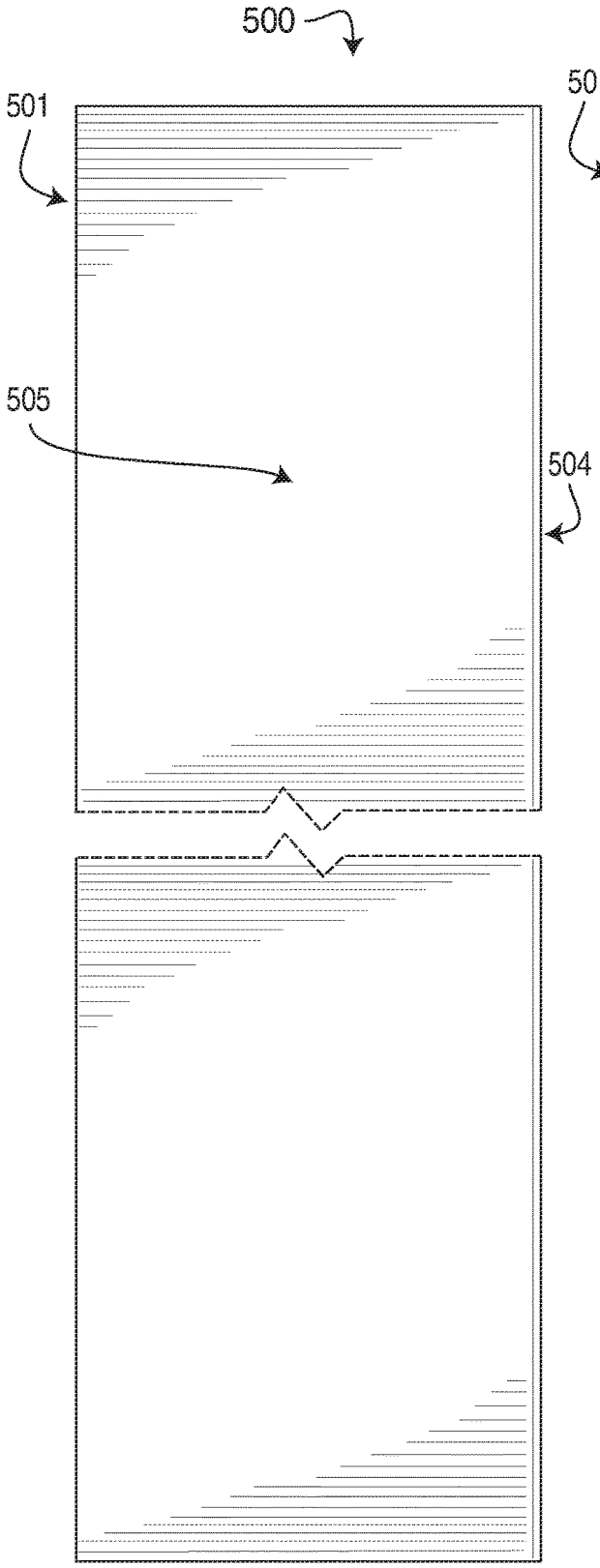
FIG. 25 is a top view of the example wall panel component.
Figure 26:
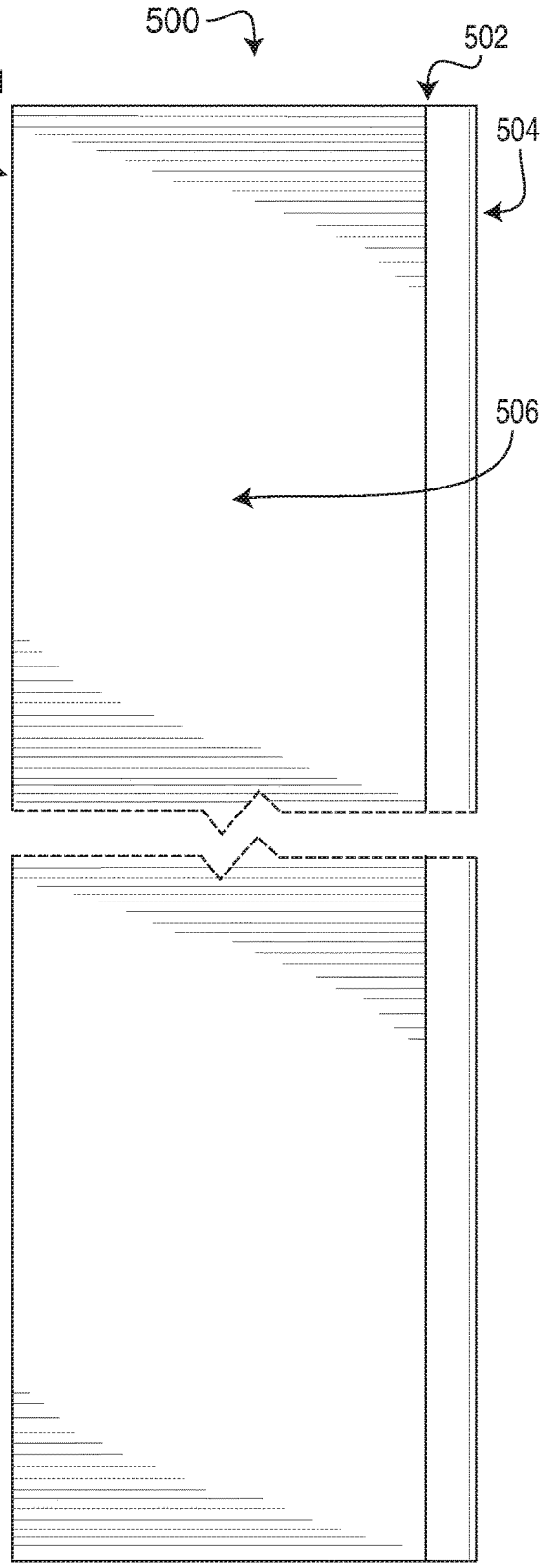
FIG. 26 is a bottom view of the example wall panel component.
Figure 27:
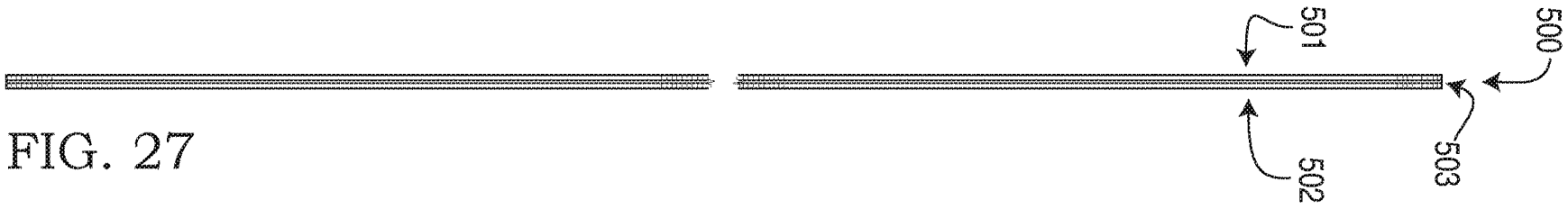
FIG. 27 is a right side view of the example wall panel component.
Figure 28:
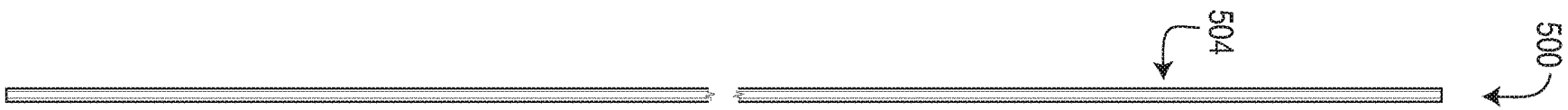
FIG. 28 is a left side view of the example wall panel component.
Figure 30:
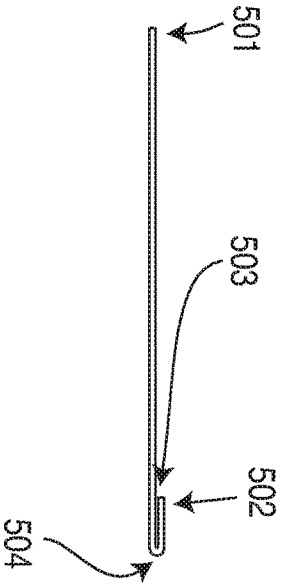
FIG. 30 is a back view of the example wall panel component.
Figure 29:
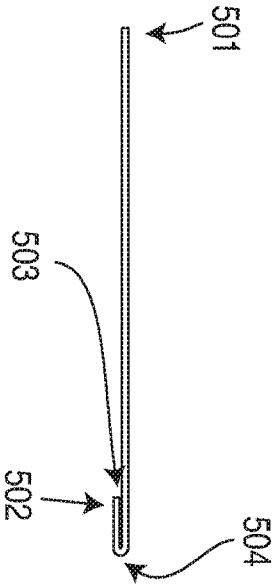
FIG. 29 is a front view of the example wall panel component.

FIG. 25 is a top view of the wall panel component 500, in which the tongue 501, back curve 504, and front face 505 are visible. FIG. 26 is a bottom view of the wall panel component 500, in which the lip 502, back curve 504, and back face 506 are visible. FIG. 27 is a right side view of the wall panel component 500, in which only the back curve 504 is visible. FIG. 28 is a left side view of the wall panel component 500, in which the tongue 501, lip 502, and groove 503 are visible. FIG. 29 is a front view of the wall panel component 500, in which the tongue 501, lip 502, groove 503, and back curve 504 are visible. FIG. 30 is a back view of the wall panel component 500, in which the tongue 501, lip 502, groove 503, and back curve 504 are visible.

The panels 500 may be any length and/or width. Multiple panels 500 may be connected from top to bottom, and from side to side, to provide any size surround. In an example, although the panels 500 have the same lip-and-groove structure as the edge trim pieces 200, corner edge components 300, and corner components 400, the panels do not interlock with one another. Rather, the shape of the panels 500 provides a U-shaped edge on one side to provide a clean and finished appearance, to reduce sharp exposed edges, and to provide a water-resistant overlap, similar to roofing shingles. However, the panels do interlock with the edge components 200 and corner edge components 300. in another example, panels that additionally interlock with one another may be provided. The panels may be straight or curved (e.g., to produce the example shower design shown in FIG. 44).

It is also noted that depending on the orientation of the panel 500 when it is inserted into other components, any edge of the panel 500 may serve as a tongue 501.

FIG. 31 is a perspective view of an example corner-side component 300 (e.g., shown in FIGS. 10-16) as it may be assembled to the corner component 400 (e.g., shown in FIGS. 17-23). For clarify of disclosure, these components are shown removed from the kit 100 corresponding to FIG. 1. However, these components may also form a part of the kit.

In an example, the corner component 400 and two corner-side components 300 have been interlocked such that the lips 302 of the two corner-side components 300 fit into the grooves 403 of the corner component 400, and the two lips 402 of the corner component fit into the grooves 303 of the corner-side components.

Figure 35:
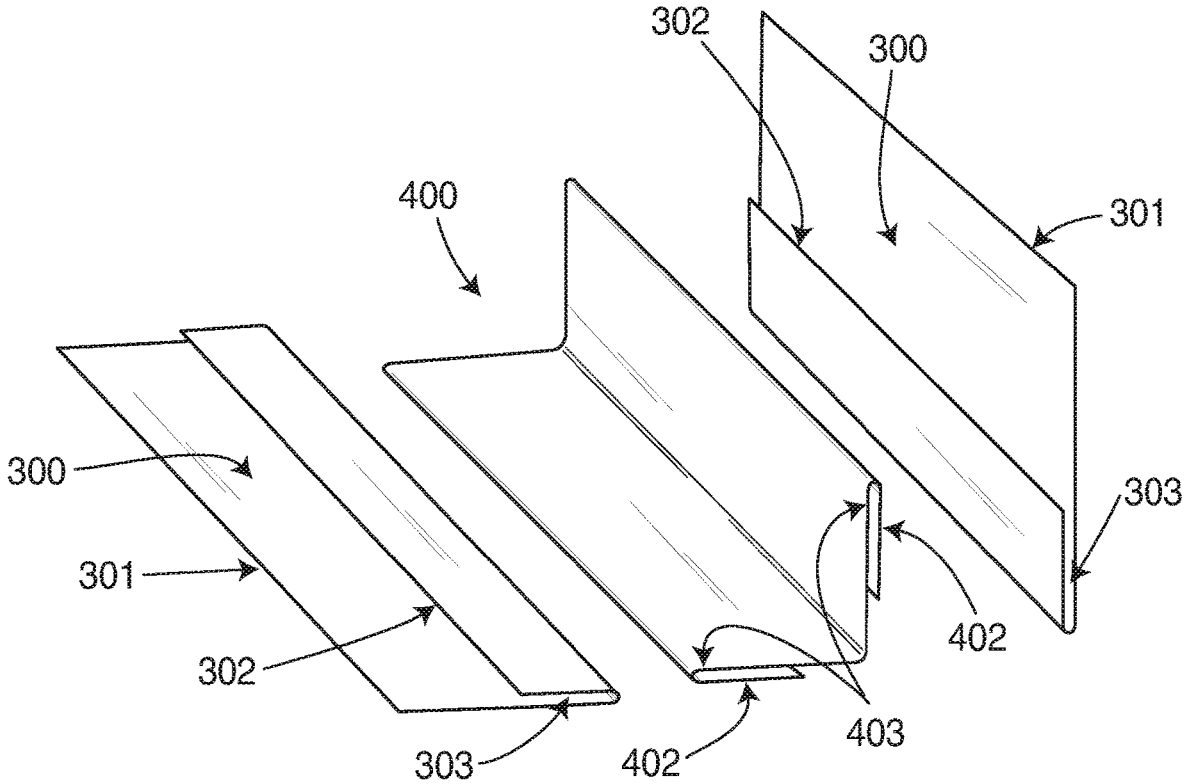
FIG. 35 illustrates assembly of an example inside corner.
Figure 35:
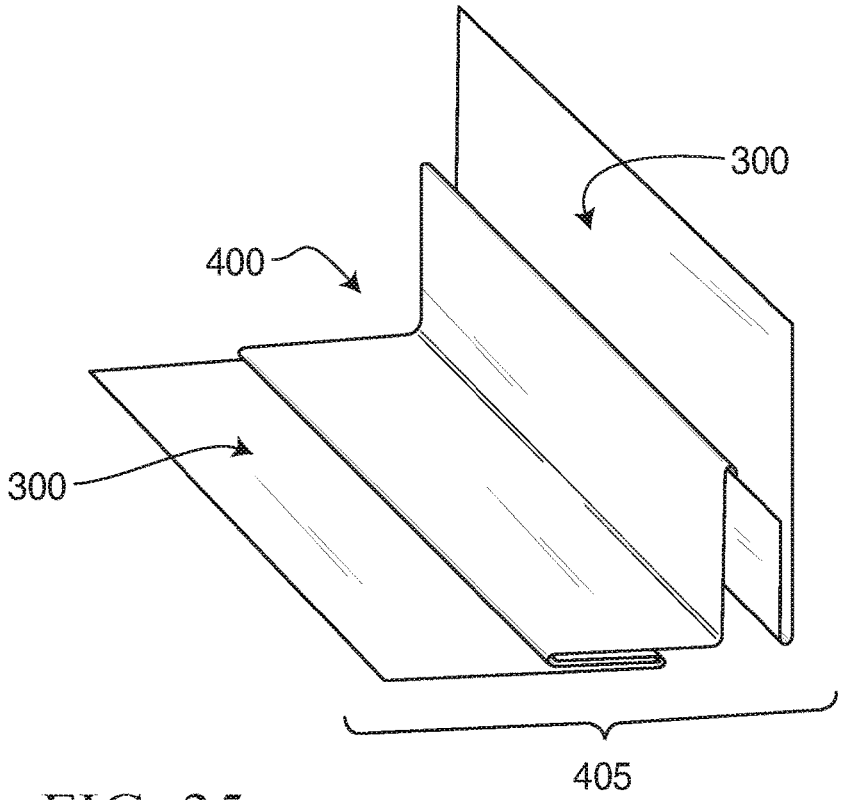
Figure 36:
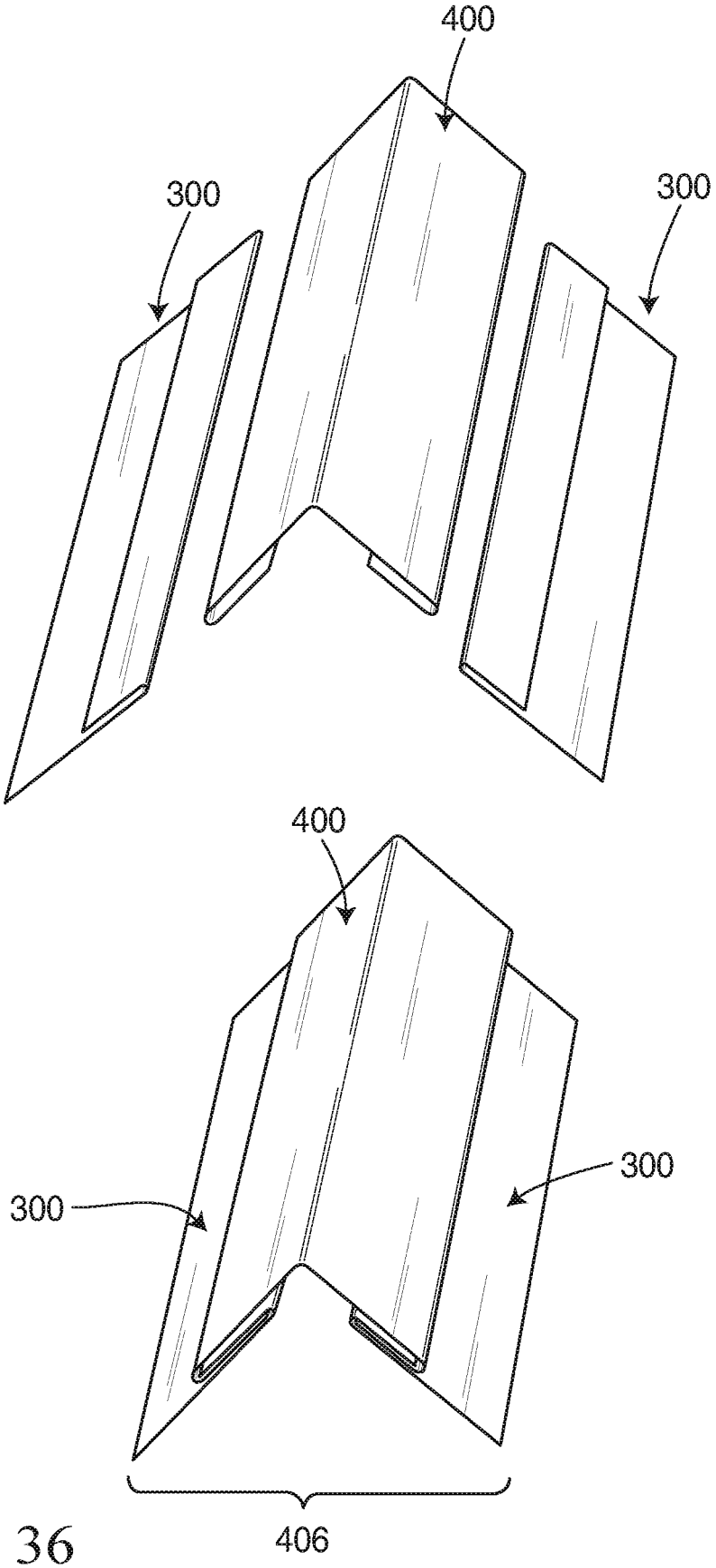
FIG. 36 illustrates assembly of an example outside corner.

It is noted that the components described herein may be assembled into a flat panel, an inside corner, or an outside corner. In an example, component 800 (see FIG. 38) can be used in it's flat configuration as a panel interconnect. The component 800 can also be folded in a first direction (e.g., as shown in FIGS. 35-36) to form an inside corner. Likewise, the component 800 can be folded "inside out" or in the opposite direction (not shown) to form an outside corner.

FIG. 32 is an exploded perspective view of the corner-side component assembled to the corner component as shown in FIG. 31, with the components separated for completeness of illustration. In an example, the corner component 400 and two corner-side components 300 are about to be interlocked such that the lips 301 of the two corner-side components 300 fit into the grooves 402 of the corner component 400, and the two lips 401 of the corner component fit into the grooves 302 of the two corner-side components.

Before continuing, it should be noted that the examples described above are provided for purposes of illustration, and are not intended to be limiting. Other devices and/or device configurations may be utilized to carry out the operations described herein.

Figure 33:
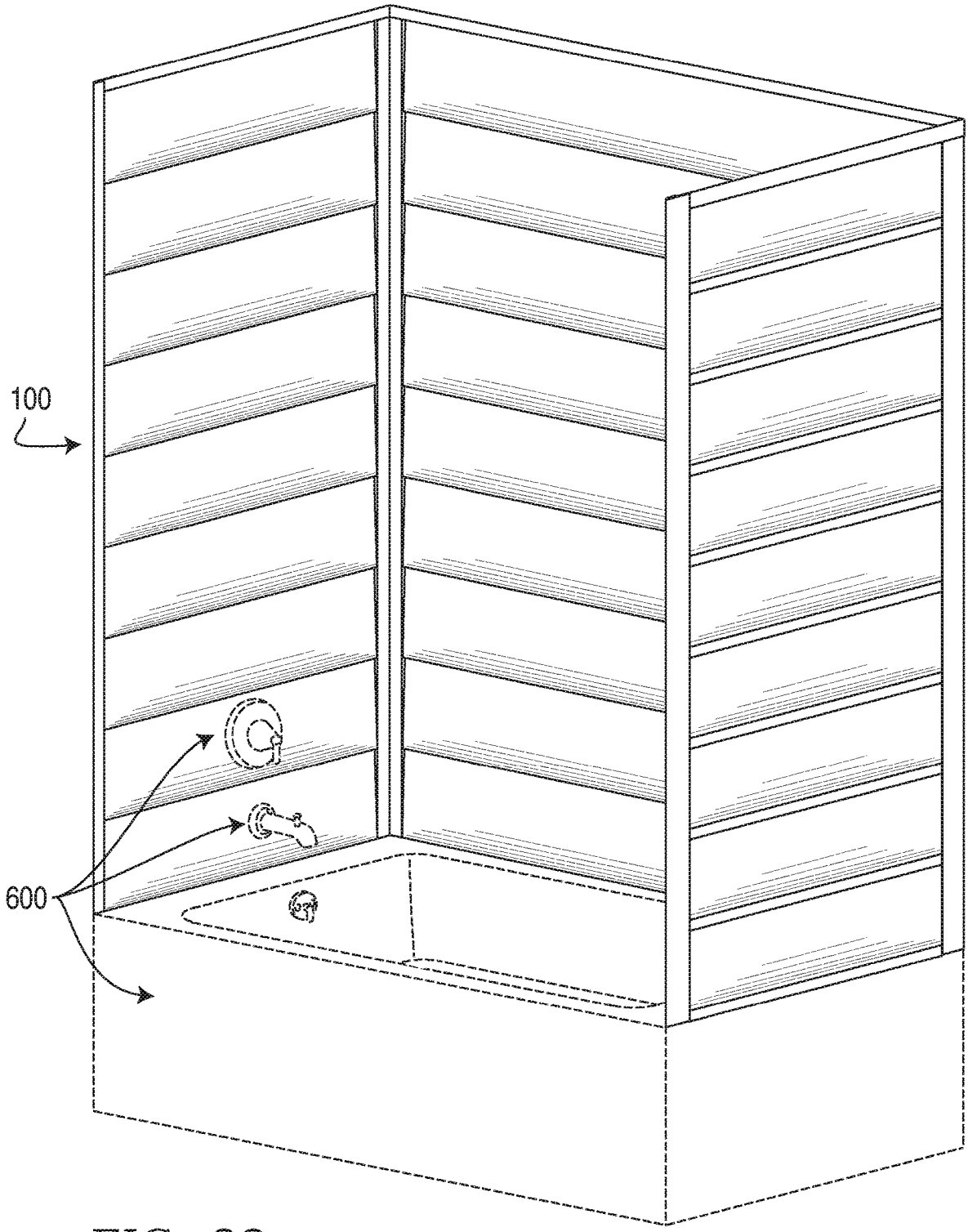
FIG. 33 is a perspective view of the example shower or tub surround kit shown as it may be installed by way of illustration on a bathtub.
Figure 34:
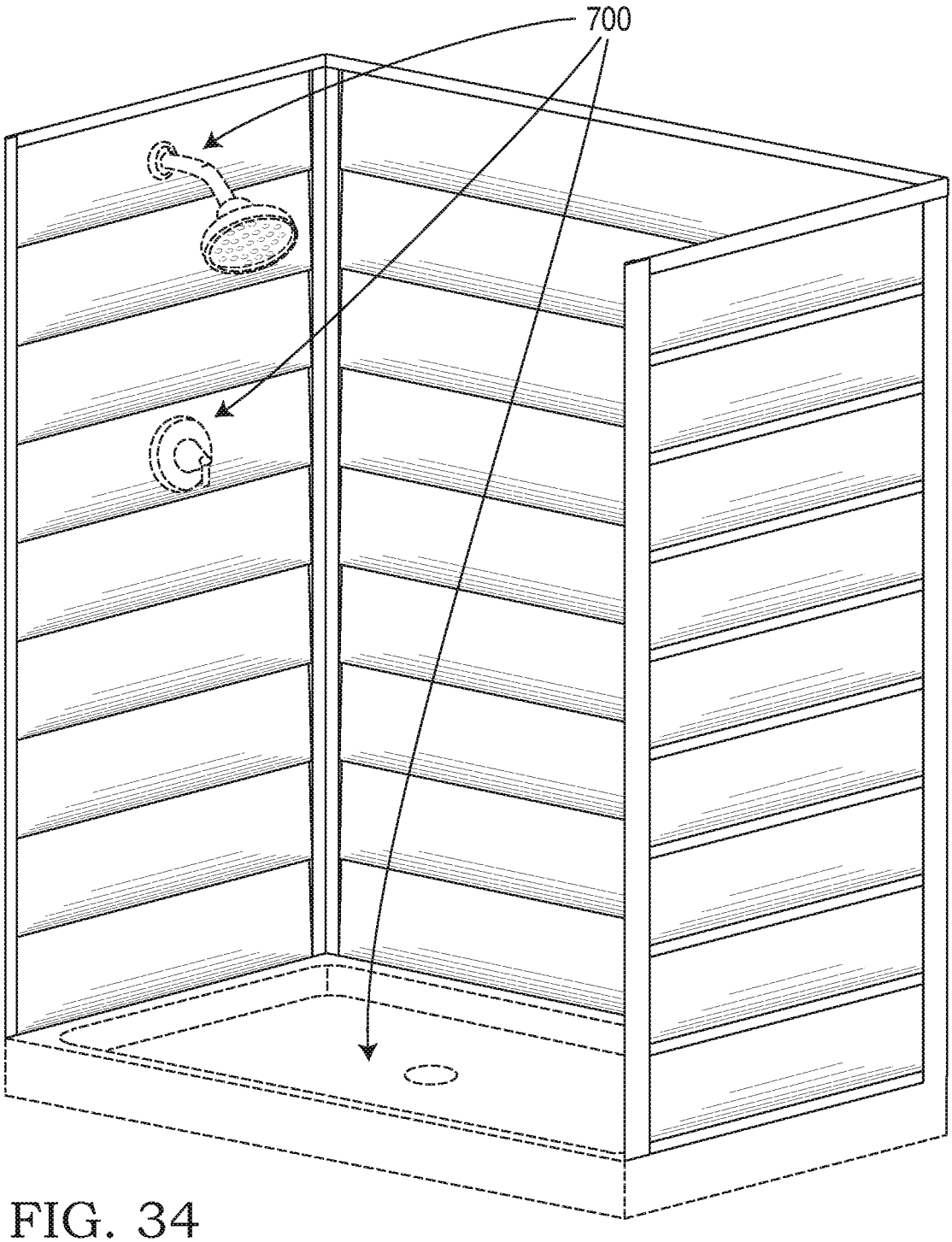
FIG. 34 is a perspective view of the example shower or tub surround kit shown as it may be installed by way of illustration on a shower.

FIG. 33 is a perspective view of the assembled shower or tub surround shown as it may be installed on a bathtub 600. FIG. 34 is a perspective view of the assembled shower or tub surround shown as it may be installed on a shower 700.

FIG. 35 illustrates assembly of an example inside corner. FIG. 36 illustrates assembly of an example outside corner. Two corner-side components 300 are inserted into a corner component 400 such that the lips 302 of the corner-side components 300 fit into the grooves 403 of the corner component 400. In an example, the lips 303 of the corner-side components 300 fit into the grooves 403 of the corner component 400.

The resulting corner assembly (inside view 405 and outside view 406) has the corner component 400 on the inside, as a matter of design choice. In an example the assembly may be largely held together by friction such that it does not require fasteners, adhesives, sealants, welds, or solder, although these may optionally be employed to hold the parts together more securely. It is noted that an outside corner may be formed in a similar manner, but corner component 400 would be folded in the opposite direction from that of the inside corner.

Figure 37:
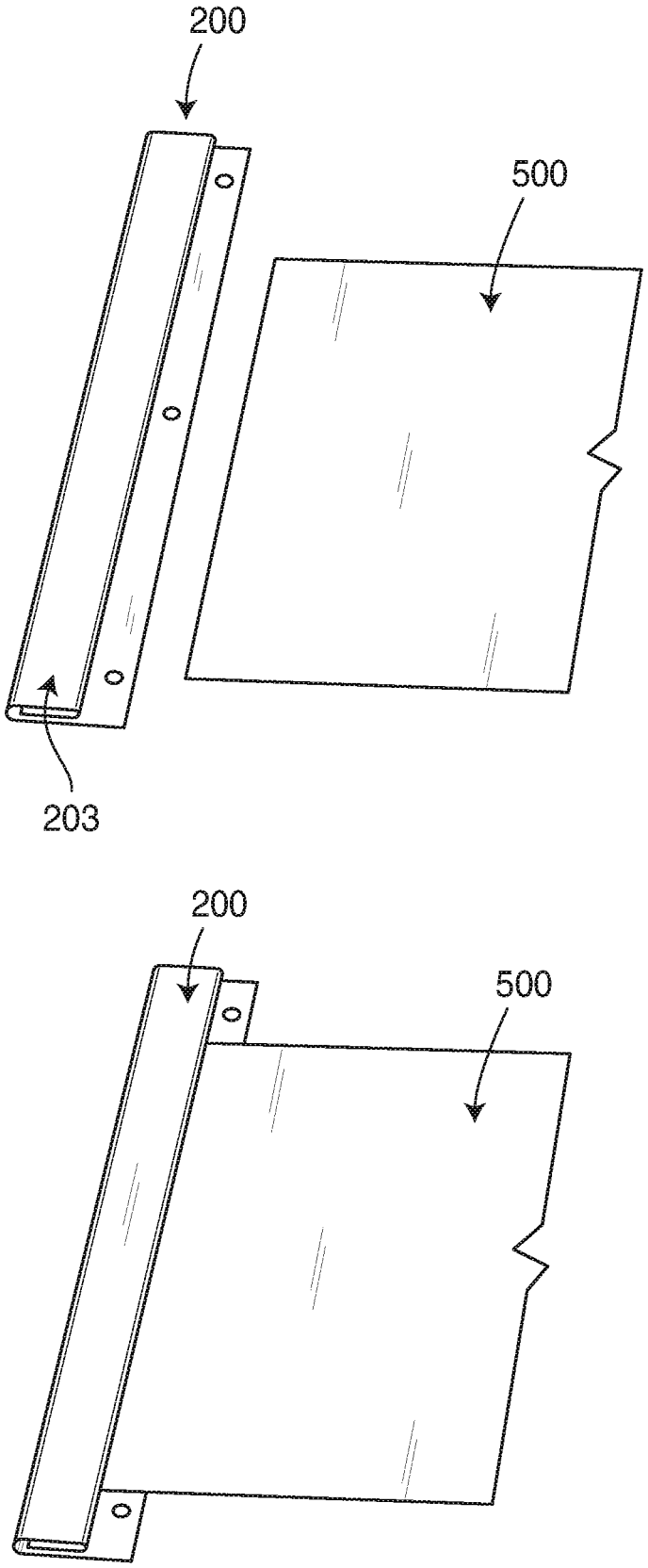
FIG. 37 illustrates assembly of an example edge component as it may be installed onto a side or top of a panel.

FIG. 37 illustrates assembly of an edge component 200 as it may be installed onto a side or top of a panel 500. Any edge of a panel 500 is inserted into the groove 203 of an edge component 200.

Figure 38:
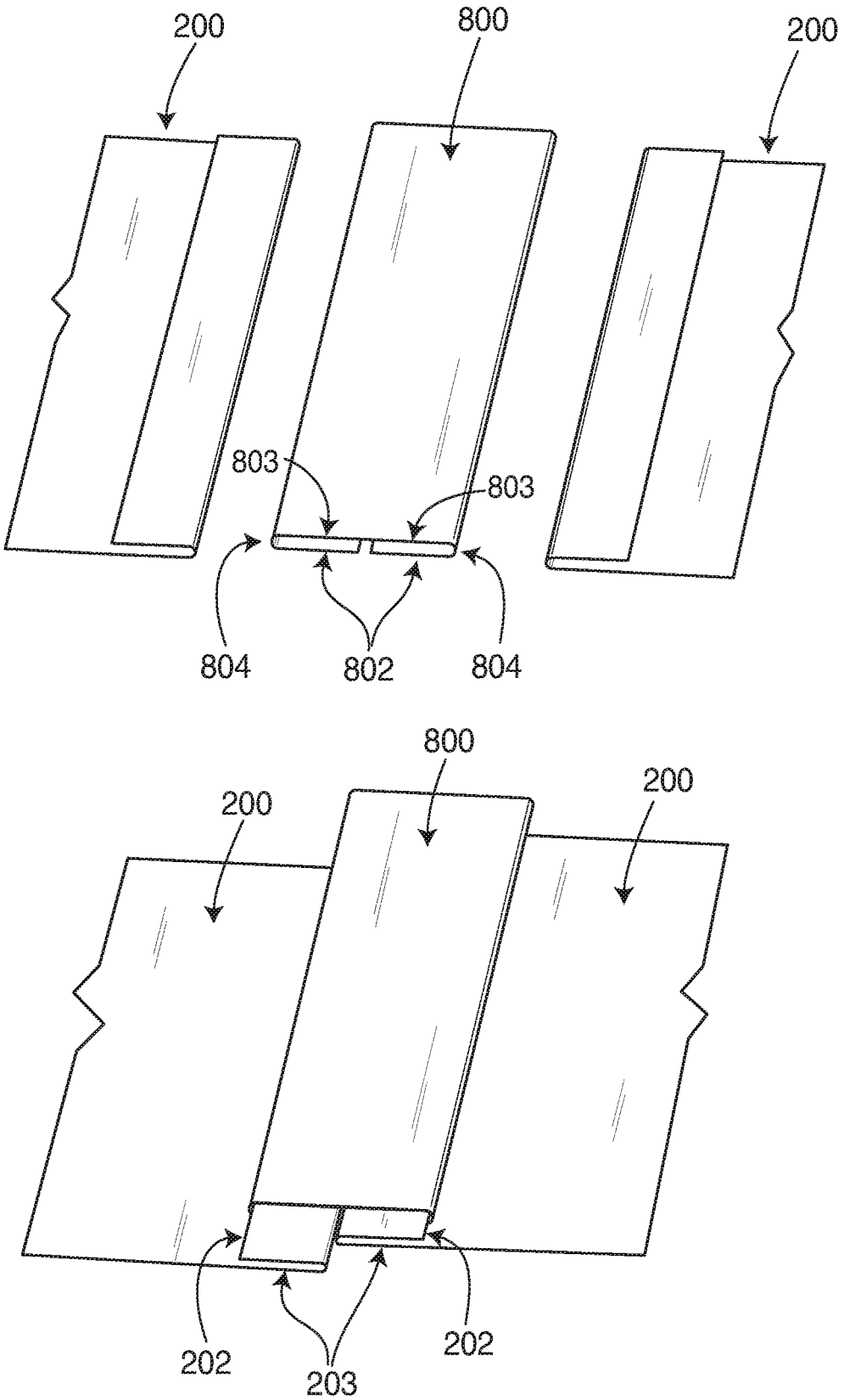
FIGS. 38-39 illustrate assembly of an example interconnection with two edge components (FIG. 38), followed by assembly of example multiple panels adjacent one another (FIG. 39).
Figure 39:
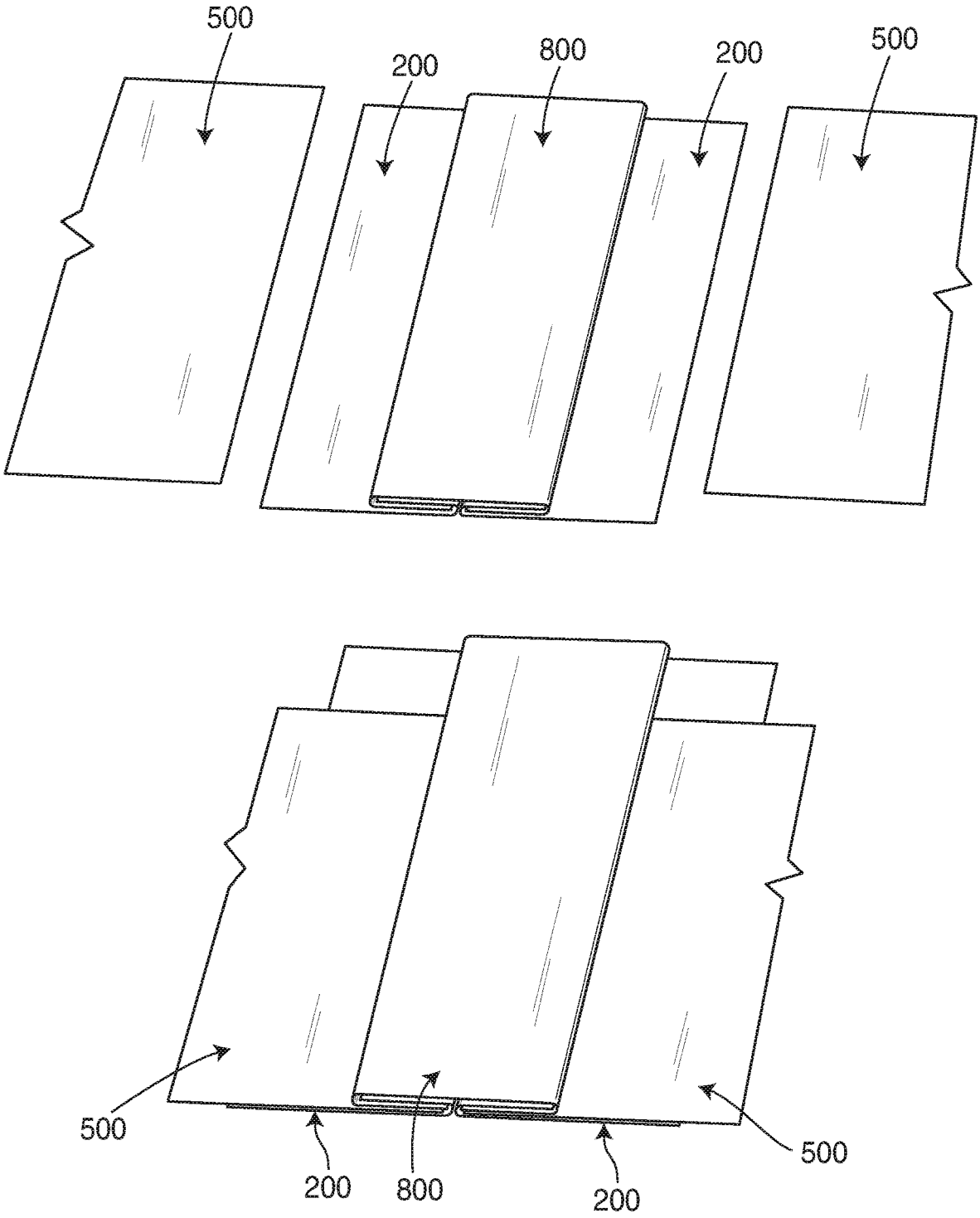

FIGS. 38-39 illustrate assembly of an example interconnection with two edge components (FIG. 38), followed by assembly of example multiple panels adjacent one another (FIG. 39). An interconnection 800 provides two lips 802, two grooves 803, and two back curves 804, which interlock with the edge components 200 such that the lips 202 of the edge components 200 fit into the grooves 803 of the interconnection 800, while the lips 802 of the interconnection 800 fit into the grooves 203 of the edge components. As will be readily appreciated by those having ordinary skill in the art after becoming familiar with the teachings herein, the interconnection 800 may be used to connect other components including but not limited to corner-side components 300, corner components 400, and panels 500 in various combinations, thus enabling a large plurality of possible shapes and forms.

It will also be appreciated by one of ordinary skill in the art that if the interconnection 800 is made wider, such that its two lips 802 are farther apart, the interconnection 800 may serve as an interlocking panel, where the tongue 501 of the panel has been replaced by a second lip 502, groove 503, and back curve 504. In this manner, interconnecting panels, as described above, may be fashioned, wherein the lip 502 of a first panel fits into the groove 503 of a second panel, while the lip 502 of the second panel fits into the groove 503 of the first panel.

In FIG. 39, multiple panels 500 are assembled adjacent one another. The interconnect 800 is shown as it has already been assembled with two edge components 200, and the two panels 500 are inserted such that any edge of the panels 500 fit into the grooves 203 of the two edge components 200.

Figure 40:
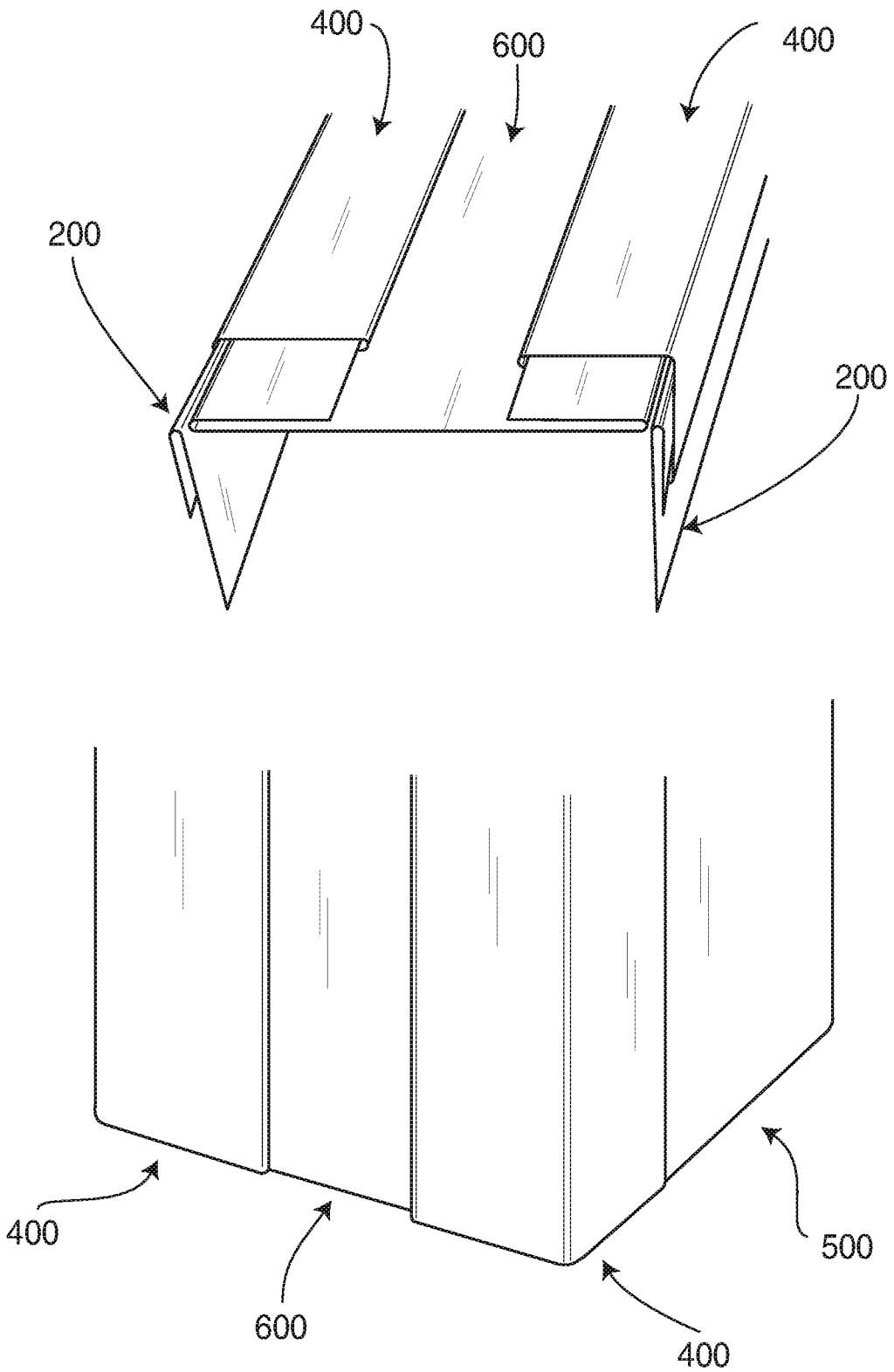
FIG. 40 illustrates an example assembly of two example outside corners and a panel to surround a wall.

FIG. 40 illustrates an example assembly of two outside corners (as depicted in FIG. 35) and a panel 500 made to surround a wall. Other sizes and arrangements are also contemplated, but this example illustrates the versatility of the tub or shower surround kit system 100 to accommodate different geometries.

Figure 41:
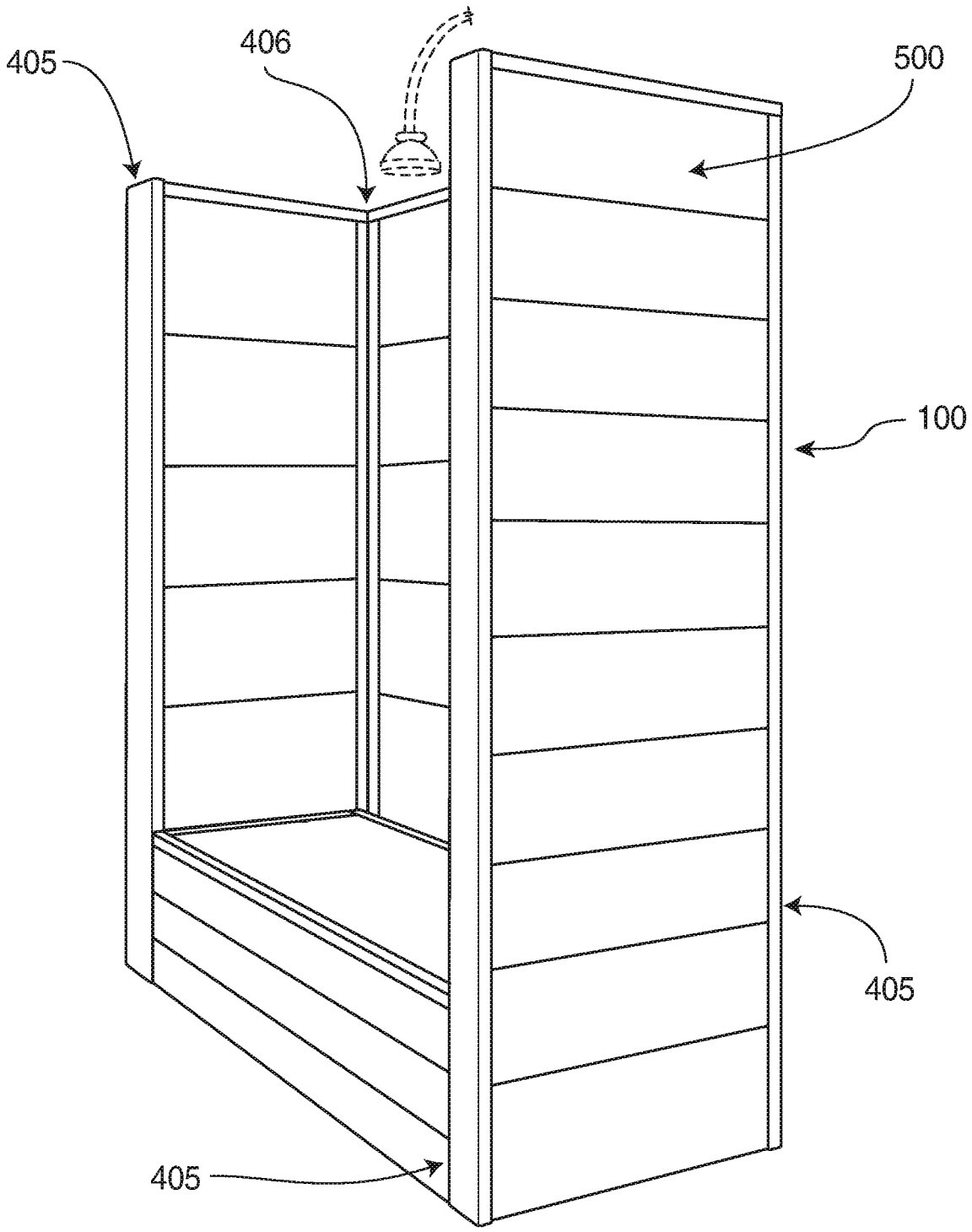
FIG. 41 illustrates an example three-sided shower surround.

FIG. 41 illustrates an example three-sided shower surround that has been constructed from the tub or shower surround kit system 100. The panels 500 have been attached to the inside and outside of a shower wall as described above, in a system that incorporates both outside corners 405 as shown in FIG. 35, and inside corners 406 as shown in FIG. 36.

Figure 42:
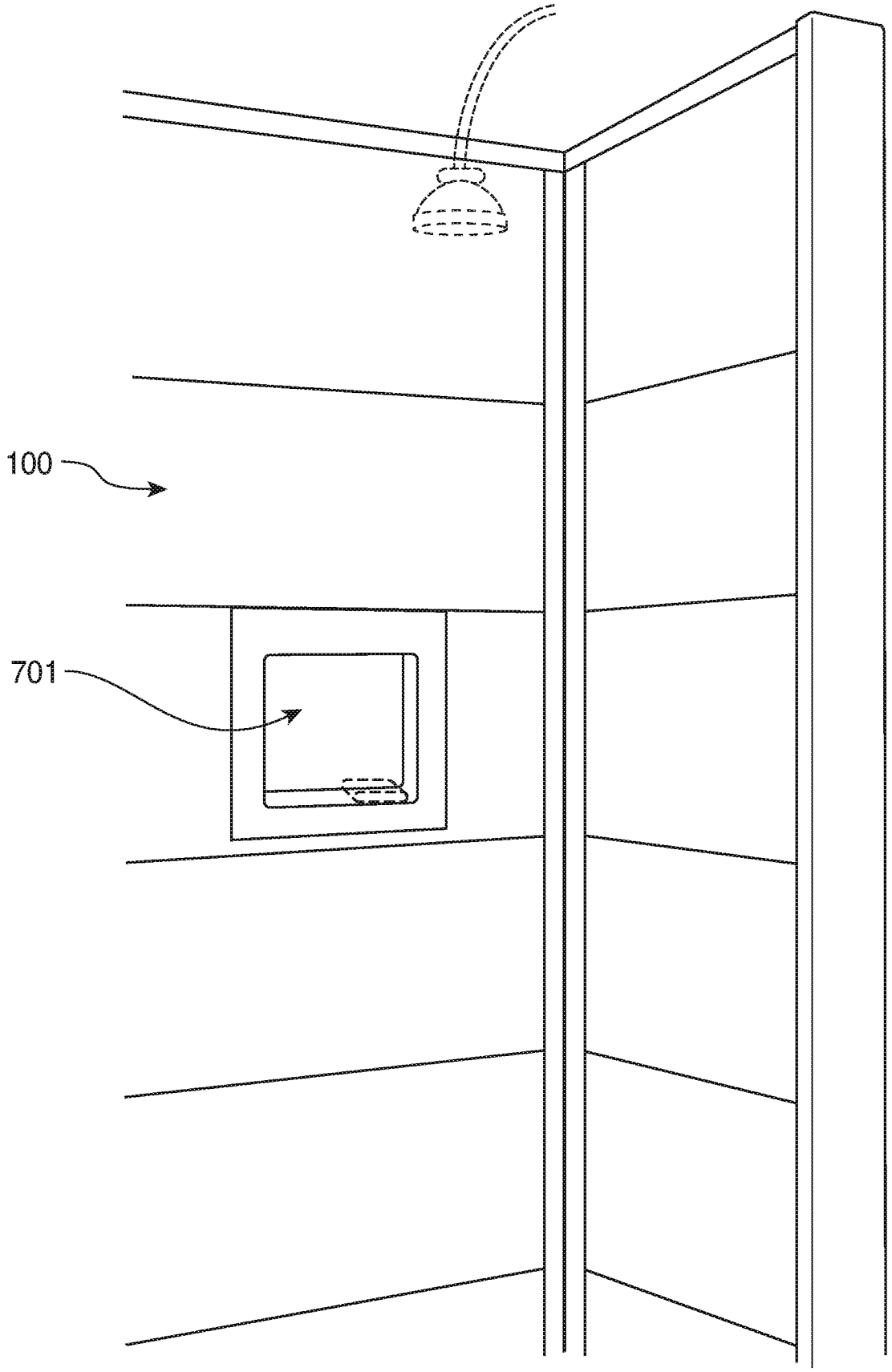
FIG. 42 illustrates a partial view of an example shower surround that includes a soap dish shelf.

FIG. 42 illustrates a partial view of an example shower surround that includes a soap dish shelf 701. The interlocking component shapes and sizes of the tub or shower surround kit system 100 have been adapted to create a soap dish shelf 701. Notches, apertures, and custom-shaped components may also be used to accommodate other features such as faucets, taps, shower heads, drains, air vents, doors, windows, and handles.

Figure 43:
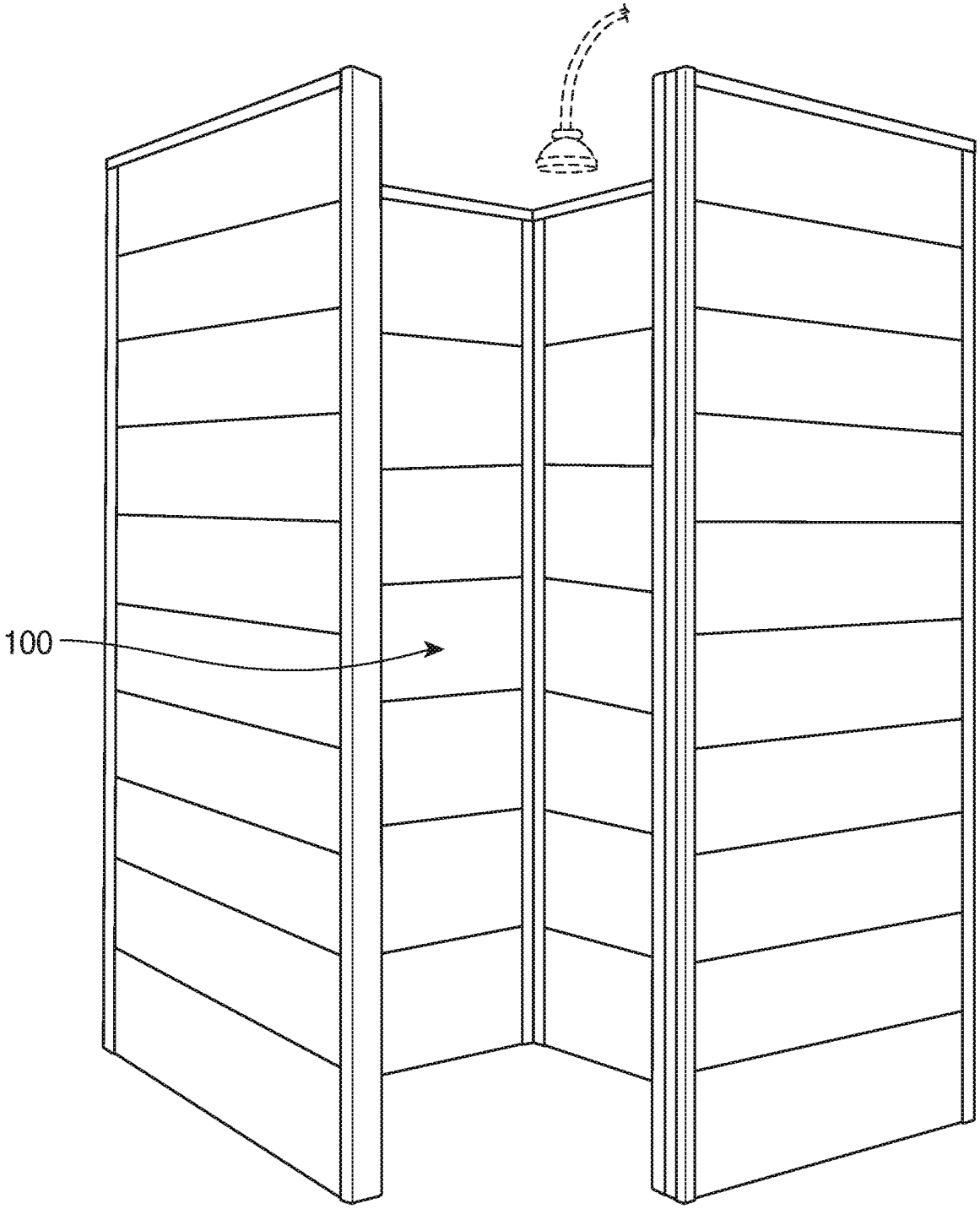
FIG. 43 illustrates an example four-sided shower surround, wherein an outer wall is made from different materials than the inner walls.

FIG. 43 illustrate an example wherein the tub or shower surround kit system 100 has been implemented to provide a 4-sided shower surround, wherein an outer wall is made from different materials than the inner walls, although it is made from the same or substantially similar component sizes and shapes.

Figure 44:
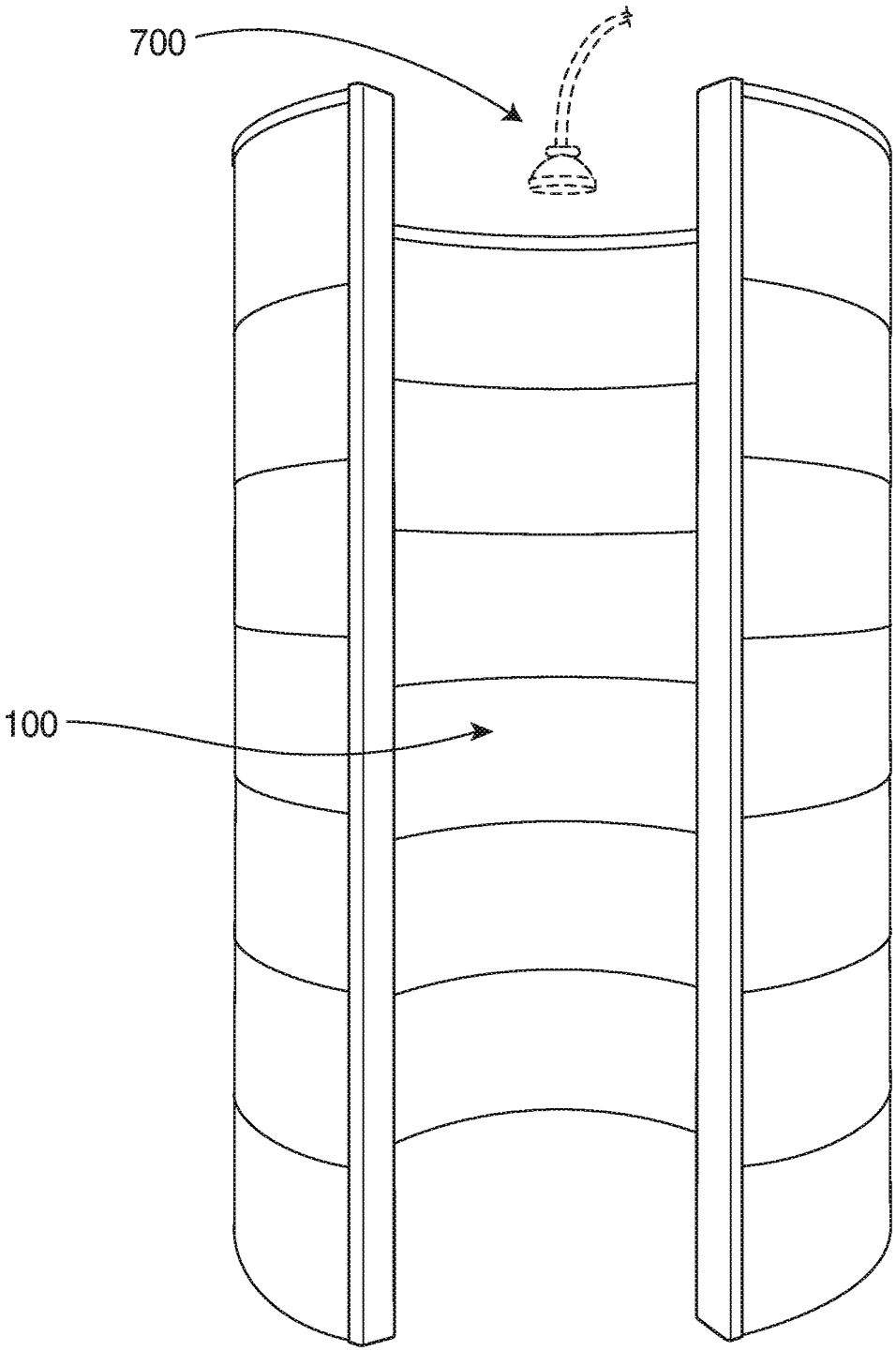
FIG. 44 illustrates an example curved shower surround.

FIG. 44 illustrates an example wherein the tub or shower surround kit system 100 has been implemented to provide a curved shower surround that fits onto a curved shower wall for a shower 700. As can be seen, this implements a combination of both straight and curved components, which may be either standardized or custom-built for a particular project.

Of course, other implementations are also contemplated and are virtually unlimited, based only on the components provided as a part of the kit 100, as well as their standardized or customized shapes and materials. Components may be straight or curved, and may have other relative or absolute dimensions than shown in the Figures. Notches and apertures may be fashioned into components. The tongue of any component may be replaced with a lip, groove, and back curve, or vice-versa. One or more lips, grooves, and back curves of a component may be reoriented to allow for different connection geometries than shown in the Figures.

It is further noted that the term "back curve" is used for naming purposes only, and the elements so named may be rectangular rather than curved in cross section, or have some other shape as a matter of design choice, while preserving the overall geometry and function of the tub or shower surround kit system.

All of these implementations of the tub or shower surround kit system, and other example implementations, will be readily understood by those having ordinary skill in the art after becoming familiar with the teachings herein.

It is noted that the examples shown and described are provided for purposes of illustration and are not intended to be limiting. Still other examples are also contemplated.

The invention claimed is:

1. A method for constructing a tub surround, shower surround, or wall covering, comprising:

providing a plurality of components to form a kit including at least edge components, a corner assembly, a plurality of overlapping side panels, and interconnection components, the plurality of components selected to fit a desired wall geometry;

wherein the corner assembly is formed of at least three separate components including a corner component, a first corner side component, and a second corner side component;

providing the corner component of the corner assembly, the corner component folded at about a 90 degree angle along a centerline to fit into an inside corner of the tub surround, shower surround, or wall covering, wherein a first corner slot is formed by about a 180 degree fold along a first edge of the corner component, and wherein a second corner slot is formed by about a 180 degree fold along a second edge of the corner component;

providing the first corner side component of the corner assembly, the first corner side component having a first edge slot formed by about a 180 degree fold; and providing the second corner side component of the corner assembly, the second corner side component having a second edge slot formed by about a 180 degree fold;

wherein the corner assembly is formed by joining the first corner side component to the corner component by inserting the first edge slot into the first corner slot to form a first wall panel slot, and by joining the second corner side component to the corner component by inserting the second edge slot into the second corner slot to form a second wall panel slot;

wherein some of the plurality of overlapping side panels slide into the first wall panel slot, and other of the plurality of overlapping side panels slide into the second wall panel slot;

wherein the plurality of overlapping side panels form shingled wall panels; and wherein erecting the plurality of components over a wall adjacent the tub or shower forms the tub surround, shower surround, or wall covering.

2. The method of claim 1, wherein the components are attached to one another and to the wall by any one or more of adhesives, fasteners, sealants, welds, and solder.

3. The method of claim 1, wherein the components are at least one of standard dimensions and custom dimensions.

4. A system for constructing a tub surround, shower surround, and wall covering, comprising:

a plurality of components including at least one a corner assembly, a plurality of overlapping side panels, at least one edge component, and at least one interconnecting component;

wherein the corner assembly is formed of at least three separate components including:

a corner component of the corner assembly, the corner component folded at about a 90 degree angle along a centerline to fit into an inside corner of the tub surround, shower surround, or wall covering, wherein a first corner slot is formed by about a 180 degree fold along a first edge of the corner component, and wherein a second corner slot is formed by about a 180 degree fold along a second edge of the corner component;

a first corner side component of the corner assembly, the first corner side component having a first edge slot formed by about a 180 degree fold; and a second corner side component of the corner assembly, the second corner side component having a second edge slot formed by about a 180 degree fold;

wherein the corner assembly is formed by joining the first corner side component to the corner component by inserting the first edge slot into the first corner slot to form a first wall panel slot, and by joining the second corner side component to the corner component by inserting the second edge slot into the second corner slot to form a second wall panel slot;

wherein some of the plurality of overlapping side panels slide into the first wall panel slot, and other of the plurality of overlapping side panels slide into the second wall panel slot;

wherein the plurality of overlapping side panels form shingled wall panels; and wherein any number of the plurality of components are connected adjacent a desired wall geometry to provide an assembled version of the tub surround, shower surround, and wall covering.

5. The system of claim 4, wherein the plurality of components are attached to one another and/or to the wall by any of adhesives, fasteners, sealants, welds, or solder.

6. A kit for constructing tub surrounds, shower surrounds, and wall coverings, comprising:

a corner assembly formed of at least three separate components including:

a corner component of the corner assembly, the corner component folded at about a 90 degree angle along a centerline to fit into an inside corner of the tub surround; shower surround, or wall covering, wherein a first corner slot is formed by about a 180 degree fold along a first edge of the corner component, and wherein a second corner slot is formed by about a 180 degree fold along a second edge of the corner component;

a first corner side component of the corner assembly, the first corner side component having a first edge slot formed by about a 180 degree fold;

a second corner side component of the corner assembly, the second corner side component having a second edge slot formed by about a 180 degree fold;

wherein the corner assembly is formed by joining the first corner side component to the corner component by inserting the first edge slot into the first corner slot to form a first wall panel slot, and by joining the second corner side component to the corner component by inserting the second edge slot into the second corner slot to form a second wall panel slot;

wherein some of the plurality of overlapping side panels slide into the first wall panel slot, and other of the plurality of overlapping side panels slide into the second wall panel slot;

wherein the plurality of overlapping side panels form shingled wall panels.

7. The kit of claim 6, wherein the components are attached to one another and/or to the wall by any of adhesives; fasteners, sealants; welds, or solder.

8. The kit claim 6, wherein some of the two or more components are of standard sizes and some of the two or more components are custom sizes.

9. The kit of claim 6, further comprising:

additional components, each of which provides either at least one tongue that connects to a groove of another component, or at least one groove that connects to the lip of another component.

10. The kit of claim 6, further comprising fasteners that fit through holes in the components in order to secure the components to one another.

11. The kit of claim 6, further comprising components having two or more lips that are friction fitted into one or more slots of other components.

12. The kit of claim 6, further comprising wall hanging components.

13. The kit of claim 6, further comprising:

a plurality of wall panels;

a plurality of edges, corner sides, corners, and interconnections;

wherein each panel, edge, corner side, corner, and interconnect is attachable to another panel, edge, corner side, corner, or interconnect by a lip-and-groove joint.

14. The kit of claim 13, further comprising fasteners that fit through holes in the panels, edges, corner sides, corners, and interconnects to secure the lip-and-groove joints.

15. The kit of claim 6, wherein components include panels, edges, corner sides, corners, and interconnects that are hooked to one another by fitting lips in each component into corresponding grooves in a neighboring component.

* * * * *